US009079650B2

(12) United States Patent
Nanjo et al.

(10) Patent No.: US 9,079,650 B2
(45) Date of Patent: Jul. 14, 2015

(54) ELECTRIC STEERING APPARATUS FOR VESSEL PROPULSION APPARATUS, AND VESSEL PROPULSION APPARATUS

(71) Applicant: YAMAHA HATSUDOKI KABUSHIKI KAISHA, Iwata-shi, Shizuoka (JP)

(72) Inventors: Morihiko Nanjo, Shizuoka (JP); Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/487,217

(22) Filed: Sep. 16, 2014

(65) Prior Publication Data

US 2015/0093947 A1 Apr. 2, 2015

(30) Foreign Application Priority Data

Oct. 1, 2013 (JP) ..... 2013-206512

(51) Int. Cl.

| | |
|---|---|
| ***B63H 25/04*** | (2006.01) |
| ***B63H 20/12*** | (2006.01) |
| ***B63H 23/30*** | (2006.01) |
| ***B63H 23/34*** | (2006.01) |
| ***B63H 25/24*** | (2006.01) |

(52) U.S. Cl.

CPC ..... *B63H 20/12* (2013.01); *B63H 23/30* (2013.01); *B63H 23/34* (2013.01); *B63H 25/24* (2013.01)

(58) Field of Classification Search

USPC ..... 114/144 RE; 440/55, 58

IPC ..... B63H 25/02,20/12

See application file for complete search history.

(56) References Cited

U.S. PATENT DOCUMENTS

| | | | | | |
|---|---|---|---|---|---|
| 2,796,576 | A * | 6/1957 | Braddon et al. | 318/588 |
| 3,181,272 | A * | 5/1965 | Gibson | 446/154 |
| 4,004,537 | A * | 1/1977 | Nilsson | 114/144 R |
| 4,782,907 | A * | 11/1988 | Morishita et al. | 180/412 |
| 7,156,034 | B2 * | 1/2007 | Mizutani | 114/162 |
| 7,549,901 | B2 * | 6/2009 | Mizuguchi et al. | 440/1 |
| 8,246,400 | B2 | 8/2012 | Ichikawa et al. | |
| 8,795,011 | B2 * | 8/2014 | Takase et al. | 440/58 |
| 2003/0024783 | A1 * | 2/2003 | Monahan et al. | 192/38 |
| 2005/0288838 | A1 * | 12/2005 | Takaki et al. | 701/41 |
| 2009/0084299 | A1 | 4/2009 | Mizutani | |

FOREIGN PATENT DOCUMENTS

JP 2009-83596 A 4/2009

* cited by examiner

*Primary Examiner* — Stephen Avila

(74) *Attorney, Agent, or Firm* — Keating & Bennett, LLP

(57) ABSTRACT

An electric steering apparatus for a vessel propulsion apparatus includes a steering motor, a lock clutch, and a rotation stopper mechanism. The steering motor generates a driving force to turn the steering shaft joined to an outboard motor. The lock clutch transmits a driving force from an input shaft to an output shaft when a forward input to transmit a driving force from the steering motor is generated, and shuts off the driving force transmission from the output shaft to the input shaft when a reverse input to transmit a driving force from the steering shaft is generated. The rotation stopper mechanism is configured to switch between a lock state in which the rotation stopper mechanism restricts rotation of the casing and a release state in which the rotation stopper mechanism releases the rotation restriction of the casing.

13 Claims, 9 Drawing Sheets

ELECTRIC STEERING APPARATUS FOR VESSEL PROPULSION APPARATUS, AND VESSEL PROPULSION APPARATUS

BACKGROUND OF THE INVENTION

1. Field of the Invention

The present invention relates to an electric steering apparatus for a vessel propulsion apparatus, and a vessel propulsion apparatus including the electric steering apparatus.

2. Description of the Related Art

U.S. Pat. No. 8,246,400 discloses a plurality of electric steering apparatuses for a vessel propulsion apparatus. Each electric steering apparatus includes a motor that generates a driving force to turn an outboard motor in the left-right direction, and a lock portion that transmits only a driving force transmitted from the upstream side to the downstream side.

The electric steering apparatus shown in FIG. 5 of U.S. Pat. No. 8,246,400 (hereinafter, referred to as "first electric steering apparatus") includes a lock release mechanism that shuts off a driving force transmission path on the downstream side of the lock portion to disable the lock portion. When a user manually steers the outboard motor, the outboard motor is directly pushed by the user in a state in which the driving force transmission path is shut off.

The electric steering apparatus shown in FIG. 24 of U.S. Pat. No. 8,246,400 (hereinafter, referred to as "second electric steering apparatus") includes a rotating member that is disposed on the upstream side of the lock portion, and rotates integrally with a rotary shaft of the motor. When a user manually steers the outboard motor, the rotating member is manually rotated by the user in a state in which the driving force transmission path is not shut off. Accordingly, the motor rotates, and the force of the user applied to the rotating member is transmitted to the outboard motor via the transmission path.

In the first electric steering apparatus, in the state in which the driving force transmission path is shut off, the outboard motor is manually steered by a user. Therefore, when the outboard motor is manually steered, only members disposed on the downstream side of the shut-off position move together with the outboard motor. Therefore, the positional relationship between the upstream side of the shut-off position and the downstream side of the shut-off position changes. For example, the relationship between the rotation angle of the motor and the steered angle of the outboard motor changes. Therefore, after this, an operation to restore the changed positional relationship is required.

In the second electric steering apparatus, the rotary shaft of the motor rotates by the same rotation angle as that of the rotating member. The rotation of the motor is decelerated, so that when a user manually steers the outboard motor, the user is required to rotate the rotating member a number of times. Therefore, the steering operation is troublesome, and it takes time to move the outboard motor to an intended steered angle.

SUMMARY OF THE INVENTION

In order to overcome the previously unrecognized and unsolved challenges described above, a preferred embodiment of the present invention provides an electric steering apparatus for a vessel propulsion apparatus, the electric steering apparatus including a steering motor, a lock clutch, and a rotation stopper mechanism. The steering motor generates a driving force to turn the steering shaft joined to an outboard motor. The lock clutch includes an input shaft to which rotation is transmitted from the steering motor, an output shaft that transmits the rotation transmitted to the input shaft to the steering shaft, and a casing that rotatably holds the input shaft and the output shaft. The lock clutch transmits a driving force from the input shaft to the output shaft when a forward input in which a driving force is transmitted from the steering motor to the steering shaft is generated, and transmits a driving force from the output shaft to the casing so as to shut off the driving force transmission from the output shaft to the input shaft when a reverse input in which a driving force is transmitted from the steering shaft to the steering motor is generated. The rotation stopper mechanism is configured to switch between a lock state in which the rotation stopper mechanism restricts (i.e., prevents) rotation of the casing and a release state in which the rotation stopper mechanism releases the rotation restriction of the casing.

With this arrangement, the lock clutch that shuts off a reverse input is disposed in the transmission path extending from the steering motor to the steering shaft. When a forward input in which a driving force is transmitted from the steering motor to the lock clutch is generated, the lock clutch transmits the driving force from the input shaft to the output shaft. On the other hand, when a reverse input in which a driving force is transmitted from the steering shaft to the lock clutch is generated, the lock clutch transmits the driving force from the output shaft to the casing and shuts off the transmission of the driving force from the output shaft to the input shaft.

When the rotation stopper mechanism is in the lock state, rotation of the casing is restricted by the rotation stopper mechanism. When a reverse input is generated, a force applied to the output shaft of the lock clutch is transmitted to the casing. In the lock state, rotation of the casing is restricted, so that even if a reverse input is generated in the lock state, rotations of the output shaft and the casing are restricted. Therefore, even if a user pushes the outboard motor in the left-right direction or a resistance of water caused by cruising is applied to the outboard motor, the steered angle of the outboard motor does not change. Therefore, even if the steering motor is not driven, the steered angle of the outboard motor is kept constant.

On the other hand, when the rotation stopper mechanism is in the release state, the rotation restriction of the casing by the rotation stopper mechanism is released. In this state, when a user pushes the outboard motor in the left-right direction, the force applied to the outboard motor is transmitted to the output shaft via the steering shaft. That is, a reverse input is generated. The force applied to the output shaft is transmitted to the casing. In the release state, the rotation restriction of the casing is released so that the casing rotates together with the output shaft. In other words, in the release state, the lock clutch is disabled so that when a user pushes the outboard motor, in response to this, the outboard motor turns in the left-right direction.

Thus, the rotation stopper mechanism enables the lock clutch by restricting the rotation of the casing, and on the other hand, the rotation stopper mechanism disables the lock clutch by releasing the rotation restriction of the casing. Therefore, a user can manually steer the outboard motor without shutting off the driving force transmission path (without shutting off the physical connection from the steering motor to the steering shaft). Therefore, an adjusting operation after manual steering is reduced or eliminated. Further, a user can turn the outboard motor in the left-right direction by directly pushing the outboard motor so that the user can easily move the outboard motor to a target steered angle in a short time. In addition, the rotation stopper mechanism is only required to make the lock clutch itself rotatable, so that a simple structure is applied to the rotation stopper mechanism. Accordingly, a complicated rotation stopper mechanism is not required.

In a preferred embodiment of the present invention, the electric steering apparatus preferably further includes a bearing that rotatably supports the casing. The bearing is preferably a rolling bearing or a sliding bearing.

With this arrangement, the casing is supported rotatably by the bearing. Therefore, in the case where a torque is applied to the casing when the rotation stopper mechanism is in the release state, the casing smoothly rotates. If the casing does not smoothly rotate when the outboard motor is manually steered, the resistance to be applied to the outboard motor may increase and the outboard motor may not smoothly move in the left-right direction. Therefore, by supporting the casing rotatably by the bearing, the outboard motor is manually smoothly steered with a smaller force.

In a preferred embodiment of the present invention, the electric steering apparatus preferably further includes a steering housing that houses the steering motor and the lock clutch, and defines a rotation stopper adjusting hole extending from the outside of the electric steering apparatus toward the lock clutch. In this case, the electric steering apparatus preferably further includes a plug that is movable between a closed position at which the plug closes the rotation stopper adjusting hole and an open position at which the plug opens the rotation stopper adjusting hole.

With this arrangement, the steering motor and the lock clutch are protected from water (including seawater and fresh water) by the steering housing. Further, the rotation stopper adjusting hole extending from the outside of the steering housing toward the lock clutch is provided in the steering housing so that a user can operate the rotation stopper mechanism from the outside of the steering housing through the rotation stopper adjusting hole. Specifically, a user can operate the rotation stopper mechanism without inserting his/her hand into the steering housing. In addition, the plug that opens and closes the rotation stopper adjusting hole is provided so that a sealing property of the steering housing is improved when operation of the rotation stopper mechanism is unnecessary. Accordingly, the components (steering motor, etc.) disposed inside the steering housing are more reliably protected from water.

In a preferred embodiment of the present invention, the electric steering apparatus preferably further includes a steering housing that houses the steering motor and the lock clutch, and defines a rotation stopper adjusting hole extending from the outside of the electric steering apparatus toward the lock clutch. In this case, the rotation stopper mechanism preferably includes an operation member that closes the rotation stopper adjusting hole and is operated to switch the rotation stopper mechanism between the lock state and the release state.

With this arrangement, by an operation of the operation member performed by a user, the rotation stopper mechanism is switched between the lock state and the release state. A portion of the operation member is disposed inside the rotation stopper adjusting hole opened at the outer surface of the steering housing. Therefore, a user can operate the operation member without removing the operation member from the rotation stopper adjusting hole. Further, the user is not required to insert a portion of the tool into the steering housing through the rotation stopper adjusting hole so that the user can more easily operate the rotation stopper mechanism.

In a preferred embodiment of the present invention, the rotation stopper adjusting hole is preferably disposed at a position viewable from a position on the hull. In this case, the rotation stopper adjusting hole may be provided in, for example, the front wall of the steering housing.

With this arrangement, the rotation stopper adjusting hole provided in the steering housing is disposed at a position viewable from a position on the hull. Therefore, the user can operate the rotation stopper mechanism from a position on the hull.

In a preferred embodiment of the present invention, the rotation stopper adjusting hole may be positioned so that the rotation stopper adjusting hole and the casing of the lock clutch face each other in the radial directions of the casing.

With this arrangement, the rotation stopper adjusting hole provided in the steering housing faces the casing in the radial direction of the casing. In other words, at least a portion of the rotation stopper adjusting hole is disposed at the same position as that of the casing in the axial direction of the casing. Therefore, the distance between the rotation stopper adjusting hole and the casing becomes smaller than in the case where the rotation stopper adjusting hole and the casing deviate from each other in the axial direction. If the distance between the rotation stopper adjusting hole and the casing is long, other members may be interposed between the rotation stopper adjusting hole and the casing and complicate the path from the rotation stopper adjusting hole to the rotation stopper mechanism. Therefore, by reducing the distance between the rotation stopper adjusting hole and the casing, the path from the rotation stopper adjusting hole to the rotation stopper mechanism is prevented from becoming complicated.

In a preferred embodiment of the present invention, the rotation stopper mechanism preferably includes a friction mechanism configured to switch between a lock state in which the rotation stopper mechanism restricts rotation of the casing by a frictional force acting between a pressed surface pressed against the casing and the casing and a release state in which the rotation stopper mechanism releases the rotation restriction of the casing by weakening the pressing force on the pressed surface against the casing to be smaller than in the lock state.

With this arrangement, the pressed surface provided on the rotation stopper mechanism (friction mechanism) is pressed against the outer peripheral surface of the casing. In the lock state, due to a frictional force acting between the pressed surface and the casing, rotation of the casing is restricted. In the release state, the pressing force on the pressed surface against the casing is weakened to be smaller than in the lock state, and accordingly, the frictional force acting between the pressed surface and the casing is reduced to be smaller than in the lock state. Accordingly, the rotation restriction of the casing is released.

Thus, the state of the rotation stopper mechanism is switched by changing the pressing force on the pressed surface against the casing. Therefore, the rotation stopper mechanism enables and disables the lock clutch without shutting off the driving force transmission path. The position at which the pressed surface is pressed may be an arbitrary position as long as the position causes restriction of rotation of the casing, so that when the lock clutch is enabled again after the outboard motor is manually steered, the casing may not be returned to the original position (position before the outboard motor is manually steered). Therefore, the adjusting operation to enable the lock clutch again is eliminated.

In a preferred embodiment of the present invention, the friction mechanism preferably includes a tightening band including an inner surface on which the pressed surface that preferably has an annular shape surrounding the casing is provided, and a pressing mechanism that adjusts the pressing force on the pressed surface against the casing by changing the inner diameter of the tightening band.

With this arrangement, the pressed surface to be pressed against the outer peripheral surface of the casing is provided on the inner surface of the tightening band of the rotation stopper mechanism (friction mechanism). The inner diameter of the tightening band is changed by the pressing mechanism. Accordingly, the pressing force on the pressed surface against the casing is increased or decreased, and the state of the rotation stopper mechanism is switched. The pressed surface preferably has an annular shape surrounding the casing. Therefore, the contact area between the pressed surface and the casing increases. Therefore, the casing is reliably held by the tightening band. Accordingly, the rotation stopper mechanism reliably restricts rotation of the casing in the lock state.

In a preferred embodiment of the present invention, the tightening band may surround the whole circumference of the casing at least in the lock state.

With this arrangement, the tightening band surrounds the entire circumference of the casing so that the contact area between the pressed surface and the casing is further increased. Accordingly, the rotation stopper mechanism more reliably restricts rotation of the casing in the lock state.

In a preferred embodiment of the present invention, the friction mechanism preferably includes a contact member provided with the pressed surface and a pressing mechanism that adjusts the pressing force on the pressed surface against the casing by changing a force to push the contact member toward the casing.

With this arrangement, the pressed surface to be pressed against the outer peripheral surface of the casing is provided on the contact member of the rotation stopper mechanism (friction mechanism). The force to push the contact member toward the casing is changed by the pressing mechanism. Accordingly, the pressing force on the pressed surface against the casing is increased or decreased, and the state of the rotation stopper mechanism is switched. Therefore, the rotation stopper mechanism enables and disables the lock clutch without shutting off the driving force transmission path.

In a preferred embodiment of the present invention, the rotation stopper mechanism preferably includes a stopper mechanism configured to switch between a lock state in which the rotation stopper mechanism restricts rotation of the casing by contact between the casing and a stopper member, and a release state in which the rotation stopper mechanism releases the rotation restriction of the casing by releasing the contact between the casing and the stopper member.

With this arrangement, the stopper member that comes into contact with the casing is provided on the rotation stopper mechanism (stopper mechanism). In the lock state, the stopper member is disposed at a lock position (a position at which the stopper member comes into contact or becomes contactable with the casing). Therefore, even if a torque is applied to the casing in the lock state, rotation of the casing is restricted by the contact between the casing and the stopper member. In the release state, the stopper member is disposed at a release position (a position at which the stopper member cannot come into contact with the casing). Accordingly, the rotation restriction of the casing is released. Thus, the state of the rotation stopper mechanism is switched by changing the position of the stopper member. Therefore, the rotation stopper mechanism enables and disables the lock clutch without shutting off the driving force transmission path.

In a preferred embodiment of the present invention, the stopper mechanism preferably includes a plurality of rotation stopper portions provided on the casing and aligned in the circumferential direction of the casing, and a stopper member movable between a lock position at which the stopper member faces any of the plurality of rotation stopper portion and a release position at which facing between the stopper member and the plurality of rotation stopper portions is released. In this case, the stopper mechanism restricts rotation of the casing by contact between any of the plurality of rotation stopper portions and the stopper member.

With this arrangement, a plurality of rotation stopper portions that restrict rotation of the casing in conjunction with the stopper member are provided on the casing. When the stopper member is disposed at the lock position any of the plurality of rotation stopper portions opposes the stopper member. Specifically, the stopper member is disposed at a position at which the stopper member comes into contact or is contactable with any of the plurality of rotation stopper portions. Therefore, rotation of the casing is restricted by contact between the rotation stopper portions and the stopper member facing each other. When the stopper member is disposed at the release position, facing between the stopper member and the plurality of rotation stopper portions is released. Accordingly, the rotation restriction of the casing is released.

The plurality of rotation stopper portions are aligned in the circumferential direction of the casing. The stopper member restricts rotation of the casing regardless of which of the rotation stopper portions the stopper member faces. Therefore, when the lock clutch is enabled again after the outboard motor is manually steered, the casing may not be returned to the original position. Therefore, the adjusting operation to enable the lock clutch again is eliminated.

Another preferred embodiment of the present invention provides a vessel propulsion apparatus including the electric steering apparatus, a steering shaft to be turned around the center line of the steering shaft by the electric steering apparatus, and an outboard motor that turns around the center line of the steering shaft together with the steering shaft. With this arrangement, the same advantageous effects as those described above are obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

In the following description, a vessel propulsion apparatus 1 in a reference posture is described. In the reference posture, the crankshaft axis Ac extends in the vertical direction, and the propeller shaft axis Ap orthogonal or substantially orthogonal to the crankshaft axis Ac extends in the front-rear direction.

First Preferred Embodiment

Figure 1:
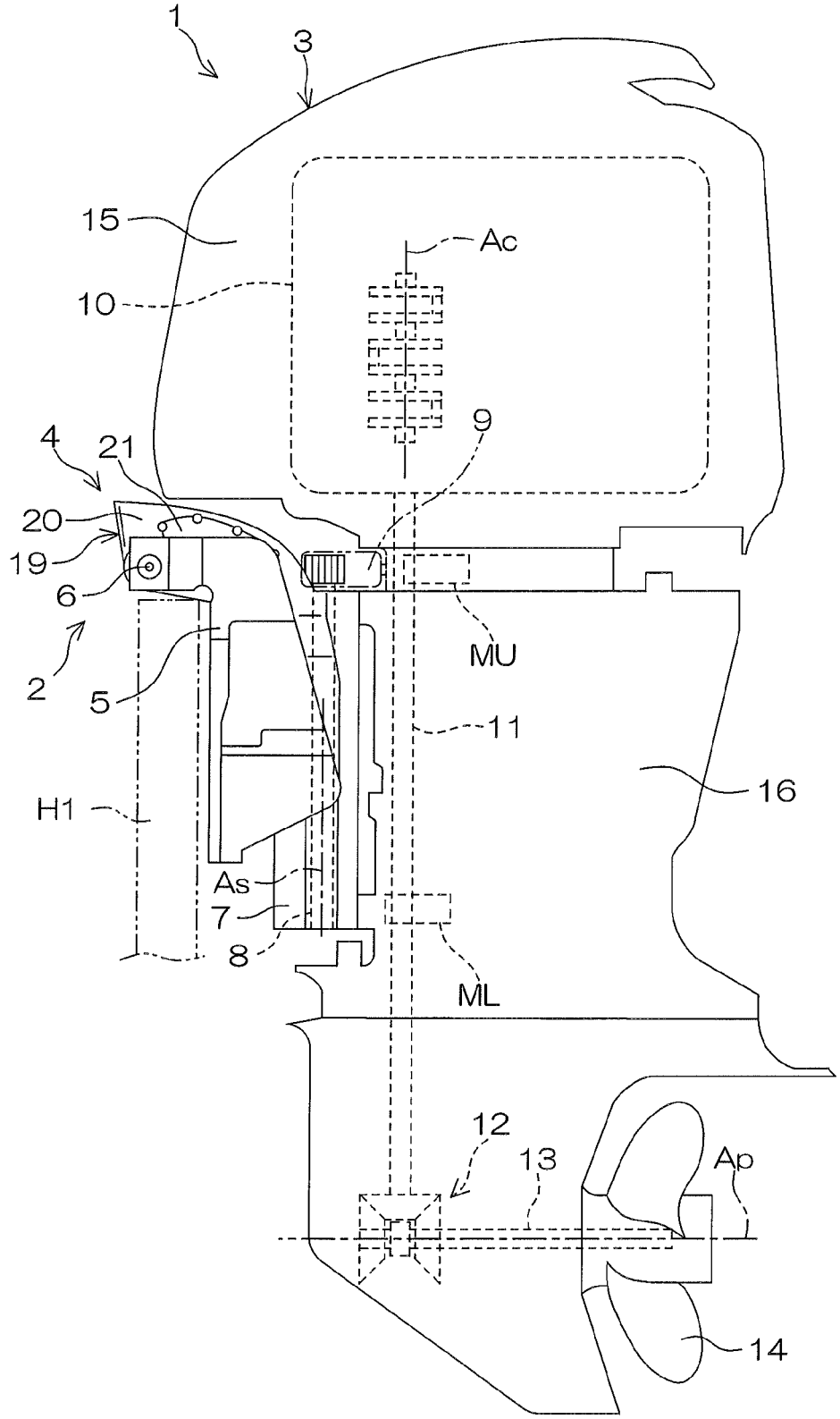
FIG. 1 is a schematic side view showing a vessel propulsion apparatus according to a first preferred embodiment of the present invention.

As shown in FIG. 1, the vessel propulsion apparatus 1 includes a suspension device 2 attachable to the rear portion (stern) of the hull H1, an outboard motor 3 joined to the suspension device 2, and an electric steering apparatus 4 that steers the outboard motor 3 in the left-right direction.

As shown in FIG. 1, the suspension device 2 includes a pair of left and right clamp brackets 5 to be attached to the hull H1, and a tilting shaft 6 supported in a posture extending in the left-right direction by the pair of clamp brackets 5. The suspension device 2 further includes a swivel bracket 7 attached to the tilting shaft 6, and a steering shaft 8 supported in a posture extending in the up-down direction by the swivel bracket 7.

Figure 2:
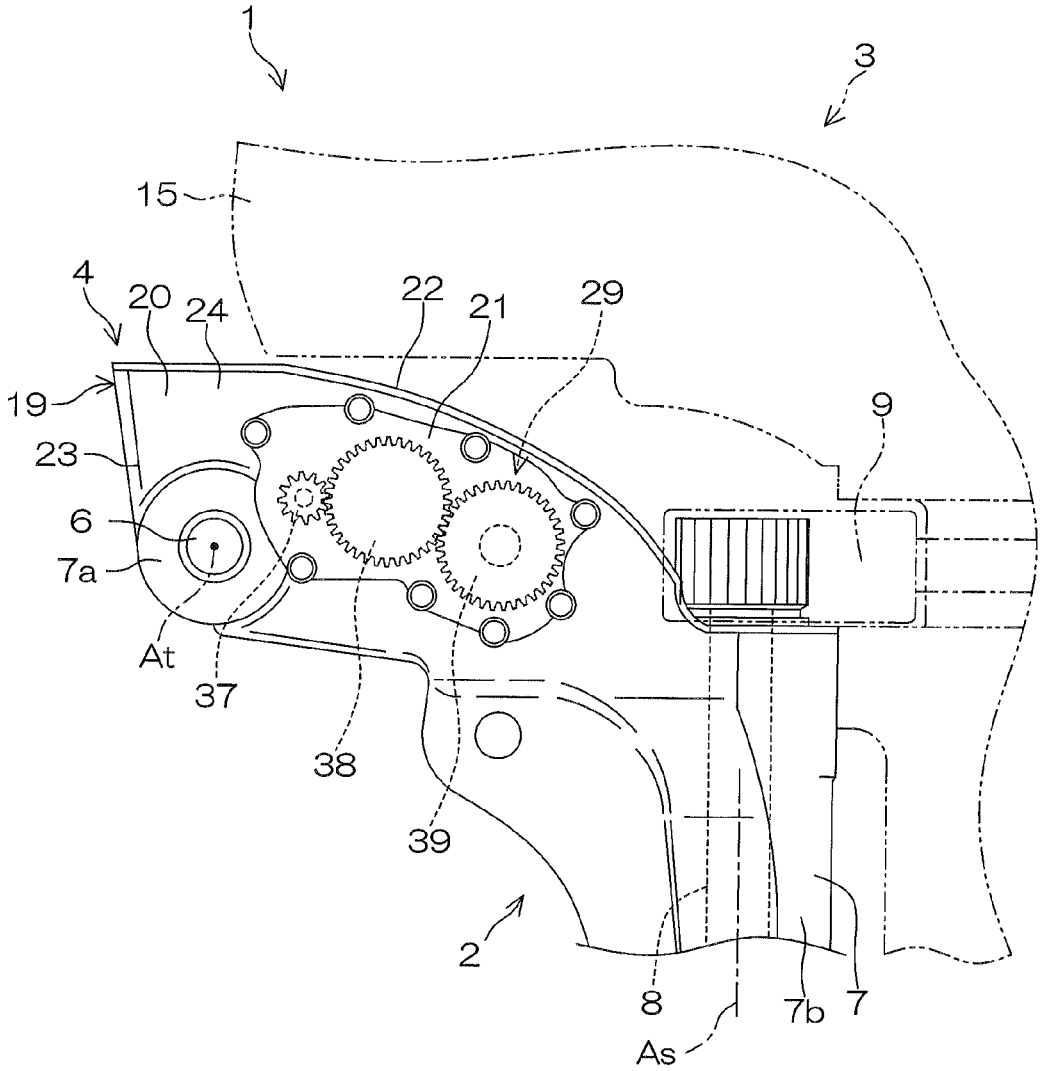
FIG. 2 is a schematic side view showing an electric steering apparatus before a swivel bracket is attached to clamp brackets.

As shown in FIG. 1, the outboard motor 3 is joined to the upper end portion of the steering shaft 8 via a mount bracket 9 and an upper mount MU. Further, the outboard motor 3 is joined to the lower end portion of the steering shaft 8 via a lower mount ML. The steering shaft 8 is supported by the swivel bracket 7 rotatably around the steering shaft axis As (center line of the steering shaft 8) extending in the up-down direction. The swivel bracket 7 is supported by the clamp brackets 5 via the tilting shaft 6. The swivel bracket 7 is turnable around the tilting shaft axis At (center line of the tilting shaft 6) extending in the left-right direction with respect to the clamp brackets 5. As shown in FIG. 2, the swivel bracket 7 includes tilting shaft holding portions 7*a* that hold the tilting shaft 6, and a steering shaft holding portion 7*b* that holds the steering shaft 8 rotatably around the steering shaft axis As.

As shown in FIG. 1, the outboard motor 3 includes an engine 10 that generates a driving force to rotate the propeller 14, and a driving force transmitting device that transmits a driving force of the engine 10 to the propeller 14. The driving force transmitting device includes a drive shaft 11 joined to the engine 10, a forward/reverse switching mechanism 12 joined to the drive shaft 11, and a propeller shaft 13 joined to the forward/reverse switching mechanism 12. The outboard motor 3 further includes an engine cover (cowling) 15 that accommodates the engine 10 and a case 16 that houses the driving force transmitting device.

As shown in FIG. 1, the engine 10 is disposed over the drive shaft 11. The drive shaft 11 extends in the up-down direction inside the case 16. The center line of the drive shaft 11 may be disposed on the rotation axis (crankshaft axis Ac) of the engine 10 or may deviate from the rotation axis of the engine 10. The upper end portion of the drive shaft 11 is joined to the engine 10, and the lower end portion of the drive shaft 11 is joined to the propeller shaft 13 via the forward/reverse switching mechanism 12. The propeller shaft 13 extends in the front-rear direction inside the case 16. The rear end portion of the propeller shaft 13 projects rearward from the case 16. The propeller 14 is removably attached to the rear end portion of the propeller shaft 13. The propeller 14 is rotatable around the propeller shaft axis Ap (the center line of the propeller shaft 13) together with the propeller shaft 13.

The engine 10 is, for example, an internal combustion engine. The engine 10 rotates in a fixed rotating direction. The rotation of the engine 10 is transmitted to the propeller 14 by the driving force transmitting device. Accordingly, the propeller 14 rotates together with the propeller shaft 13 to generate thrust to cause the vessel travel forward or backward. The direction of rotation to be transmitted from the drive shaft 11 to the propeller shaft 13 is switched by the forward/reverse switching mechanism 12. Therefore, the rotating directions of the propeller 14 and the propeller shaft 13 are switched between the forward direction (clockwise when the propeller 14 is viewed from the rear side) and the reverse direction (direction opposite to the forward direction). Accordingly, the direction of the thrust is switched.

Figure 3:
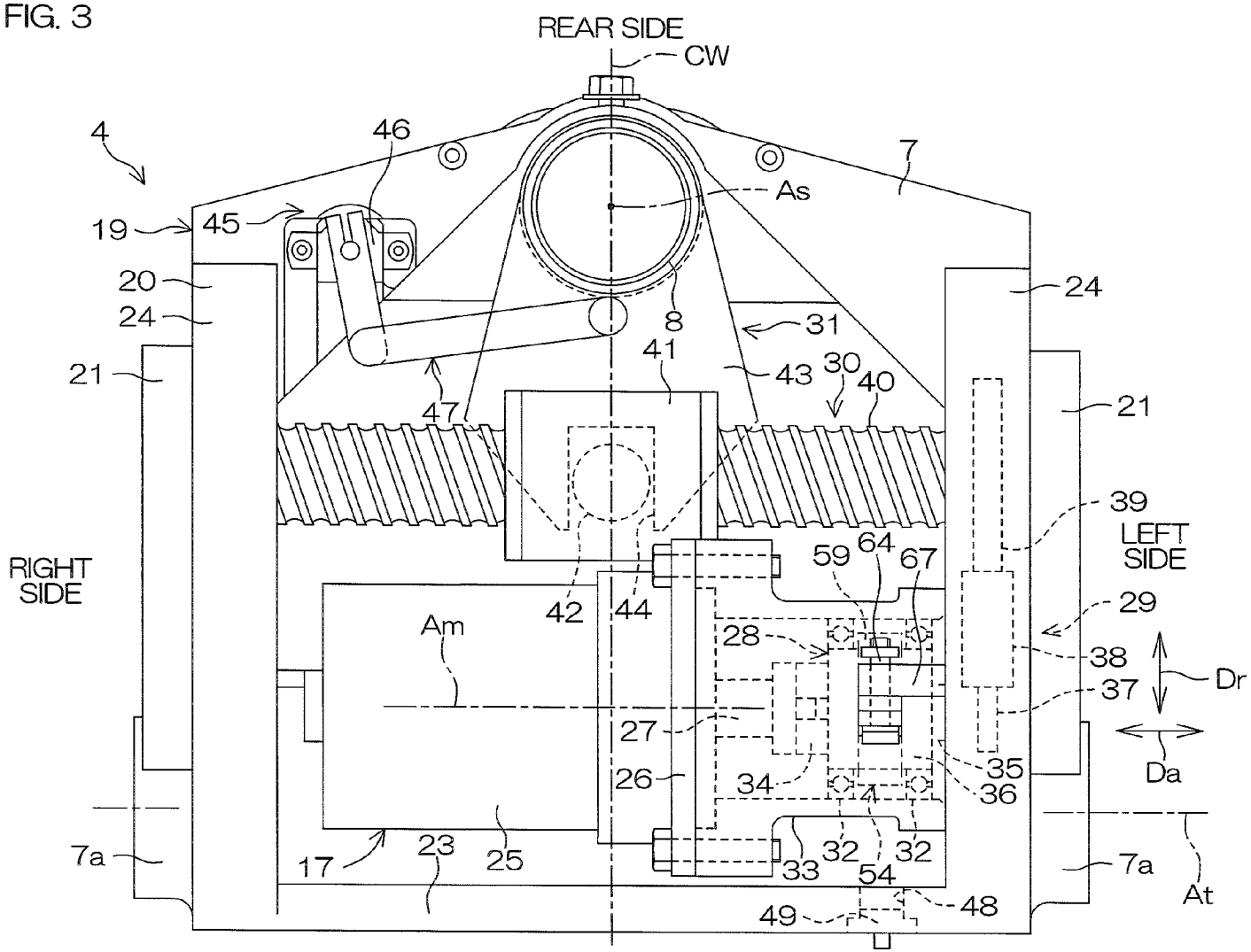
FIG. 3 is a schematic plan view showing the electric steering apparatus in a state in which an upper cover is removed.

As shown in FIG. 3, the electric steering apparatus 4 includes a steering motor 17 that generates a driving force to turn the steering shaft 8, steering force transmitting devices 28 to 31 that transmit a driving force on the transmission path of the driving force (steering force) from the steering motor 17 to the steering shaft 8, and a steering housing 19 that houses the steering motor 17 and the steering force transmitting devices.

The steering motor 17 is an electric motor to be driven by electricity. As shown in FIG. 3, the steering motor 17 is disposed in a posture in which the rotation axis Am of the steering motor 17 extends in the left-right direction inside the steering housing 19. The rotation axis Am of the steering motor 17 is disposed farther rearward than the tilting shaft axis At. The steering motor 17 includes a cylindrical motor housing 25 that houses a rotor and a stator which are not illustrated, an attaching flange 26 attached to an end portion in the axial direction of the motor housing 25, and a rotary shaft 27 projecting in the axial direction from the attaching flange 26. The motor housing 25 and the attaching flange 26 are fixed to the steering housing 19. The rotary shaft 27 is rotatable with respect to the steering housing 19.

As shown in FIG. 3, the steering housing 19 includes a housing main body 20 that houses the steering motor 17 and the steering force transmitting devices, and two side covers 21 disposed on the right and left sides of the housing main body 20. As shown in FIG. 2, the steering housing 19 further includes an upper cover 22 disposed over the housing main body 20. The side covers 21 and the upper cover 22 are removably attached to the housing main body 20. An opening provided at the upper end portion of the housing main body 20 is closed by the upper cover 22, and openings provided at the right side portion and the left side portion of the housing main body 20 are closed by the two side covers 21.

As shown in FIG. 3, the housing main body 20 includes a peripheral wall having a U-shape opened rearward in a plan view, and a bottom wall provided on the lower end portion of the peripheral wall. The peripheral wall of the housing main body 20 includes a front wall 23 extending in the left-right direction, and two side walls 24 extending rearward from the right end portion and the left end portion of the front wall 23. As shown in FIG. 2, the tilting shaft holding portions 7*a* of the swivel bracket 7 are provided on the side walls 24 of the housing main body 20. The steering shaft holding portion 7*b* of the swivel bracket 7 extends downward from the housing main body 20. The housing main body 20 is integral with the tilting shaft holding portions 7*a* and the steering shaft holding portion 7*b*. Therefore, the housing main body 30 is integral with the swivel bracket 7. The housing main body 20 may be separate from the swivel bracket 7.

As shown in FIG. 3, the steering force transmitting devices include a lock clutch 28 that transmits rotation of the steering motor 17 toward the steering shaft 8, and a gear mechanism 29 that decelerates the rotation transmitted from the lock clutch 28. The steering force transmitting devices further include a ball screw mechanism 30 that converts rotation decelerated by the gear mechanism 29 into linear motion, and a motion converting mechanism 31 that convers linear motion converted by the ball screw mechanism 30 into turning of the steering shaft 8. The electric steering apparatus 4 includes one or more (two in the example of FIG. 3) bearings 32 that rotatably support the lock clutch 28, and a clutch housing 33 that houses the bearings 32 and the lock clutch 28.

As shown in FIG. 3, the lock clutch 28 includes an input shaft 34 into which the rotation from the steering motor 17 is input, an output shaft 35 that outputs rotation input into the input shaft 34 toward the steering shaft 8, and a casing 36 that rotatably holds the input shaft 34 and the output shaft 35. The input shaft 34 is joined to the rotary shaft 27 of the steering motor 17, and the output shaft 35 is joined to the rotary shaft 27 of the steering motor 17 via the input shaft 34. The input shaft 34 and the rotary shaft 27 of the steering motor 17 are rotatable integrally around the rotation axis Am of the steering motor 17. The output shaft 35 and an upstream gear 37 of the gear mechanism 29 are rotatable integrally around the rotation axis Am of the steering motor 17.

The lock clutch 28 is a reverse input shutoff clutch that transmits torques in the forward direction and the reverse direction from the input shaft 34 to the output shaft 35, and shuts off (i.e., prevents) transmission of torques from the output shaft 35 to the input shaft 34 (for example, "torque diode (registered trademark)" made by NTN Corporation). The lock clutch 28 transmits a torque from the input shaft 34 to the output shaft 35 when a forward input to transmit a torque from the steering motor 17 to the steering shaft 8 is generated. The lock clutch 28 further transmits the torque from the output shaft 35 to the casing 36 and shuts off transmission of the torque from the output shaft 35 to the input shaft 34 when a reverse input to transmit the torque from the steering shaft 8 to the steering motor 17 is generated.

As shown in FIG. 3, the casing 36 of the lock clutch 28 is disposed inside the clutch housing 33. The bearings 32 surround the casing 36 in the circumferential direction Dc (refer to FIG. 5) of the casing 36 inside the clutch housing 33. The two bearings 32 are spaced apart by an interval in the axial direction Da of the casing 36. The bearings 32 are supported by the clutch housing 33, and the casing 36 is supported by the clutch housing 33 via the bearings 32. The casing 36 is supported rotatably by the bearings 32, and is rotatable with respect to the steering housing 19. On the other hand, the casing 36 is fixed in the axial direction thereof, and is immovable in the axial direction with respect to the steering housing 19. As described below, the casing 36 is fixed in the circumferential direction Dc of the casing 36 by the rotation stopper mechanism 54.

As shown in FIG. 3, the clutch housing 33 is disposed inside the steering housing 19. The clutch housing 33 is disposed on the lateral side of the center CW in the width direction of the outboard motor 3 (vertical plane that divides the outboard motor 3 in the reference posture into two halves in the left-right direction). The clutch housing 33 is disposed farther forward than a ball screw 40. The clutch housing 33 and the steering motor 17 are aligned in the axial direction of the steering motor 17. The rotary shaft 27 of the steering motor 17 is disposed inside the clutch housing 33. The clutch housing 33 is fixed to the attaching flange 26 of the steering motor 17 by bolts, for example. The clutch housing 33 is fixed to the steering housing 19 via the steering motor 17, and is immovable with respect to the steering housing 19.

As shown in FIG. 2 and FIG. 3, the gear mechanism 29 includes a plurality of reduction gears that transmit rotation from the lock clutch 28 to the ball screw mechanism 30. The plurality of reduction gears include an upstream gear 37 disposed on the rotation axis Am of the steering motor 17, a downstream gear 39 disposed on the rotation axis of the ball screw 40 described below, and one or more intermediate gears 38 disposed between the upstream gear 37 and the downstream gear 39. The upstream gear 37 rotates integrally with the rotary shaft 27 of the steering motor 17, and the downstream gear 39 rotates integrally with the ball screw 40. The rotation of the upstream gear 37 is transmitted to the downstream gear 30 via the intermediate gear 38. Accordingly, the rotation of the steering motor 17 is transmitted to the ball screw mechanism 30.

As shown in FIG. 3, the ball screw mechanism 30 includes a ball screw 40 that is driven to rotate by the steering motor 17, and a cylindrical ball nut 41 that surrounds the ball screw 40 via a plurality of balls. The ball screw 40 and the ball nut 41 are disposed farther rearward than the steering motor 17 inside the steering housing 19. The ball screw 40 extends in the left-right direction on the rear side of the steering motor 17. Both end portions of the ball screw 40 are supported by the steering housing 19. The ball screw 40 is rotatable around the center line of the ball screw 40 with respect to the steering housing 19. The rotation axis of the ball screw 40 and the rotation axis Am of the steering motor 17 are parallel or substantially parallel to each other. When the ball screw 40 rotates around the center line of the ball screw 40, the ball nut 41 moves in the axial direction of the ball screw 40 along the ball screw 40. Accordingly, the rotation of the ball screw 40 is converted into linear motion of the ball nut 41.

As shown in FIG. 3, the motion converting mechanism 31 includes a steering pin 42 that moves in the axial direction of the ball screw 40 together with the ball nut 41, and a steering arm 43 that turns around the steering shaft axis As together with the steering shaft 8. The steering pin 42 extends downward from the ball nut 41. The steering arm 43 extends from the steering shaft 8 to the steering pin 42. The root portion of the steering arm 43 is joined to the steering shaft 8, and the tip end portion of the steering arm 43 is disposed below the ball nut 41. The steering arm 43 includes a fork portion 44 provided on the tip end portion of the steering arm 43. The steering pin 42 is disposed inside the fork portion 44. When the steering pin 42 moves in the axial direction of the ball screw 40 together with the ball nut 41, the inner surface of the fork portion 44 is pushed by the steering pin 42, and the steering arm 43 turns. Accordingly, the outboard motor 3 and the steering shaft 8 turn around the steering shaft axis As.

As shown in FIG. 3, the electric steering apparatus 4 includes a steered angle detection device 45 that detects a steered angle of the outboard motor 3 (rotation angle of the steering shaft 8). The steered angle detection device 45 is configured to detect a steered angle of the outboard motor 3 based on a movement amount of the steering arm 43. The steered angle detection device 45 may detect a steered angle of the outboard motor 3 based on not only a movement amount of the steering arm 43 but also a movement amount of a movable portion (for example, the ball screw 40 or the ball nut 41) that is driven by the steering motor 17. In the example of FIG. 3, the steered angle detection device 45 includes a steered angle sensor 46 that detects a movement amount of the steering arm 43 as a movable portion, and a link mechanism 47 as a motion transmitting device that transmits motion of the steering arm 43 to the steered angle sensor 46.

Figure 4:
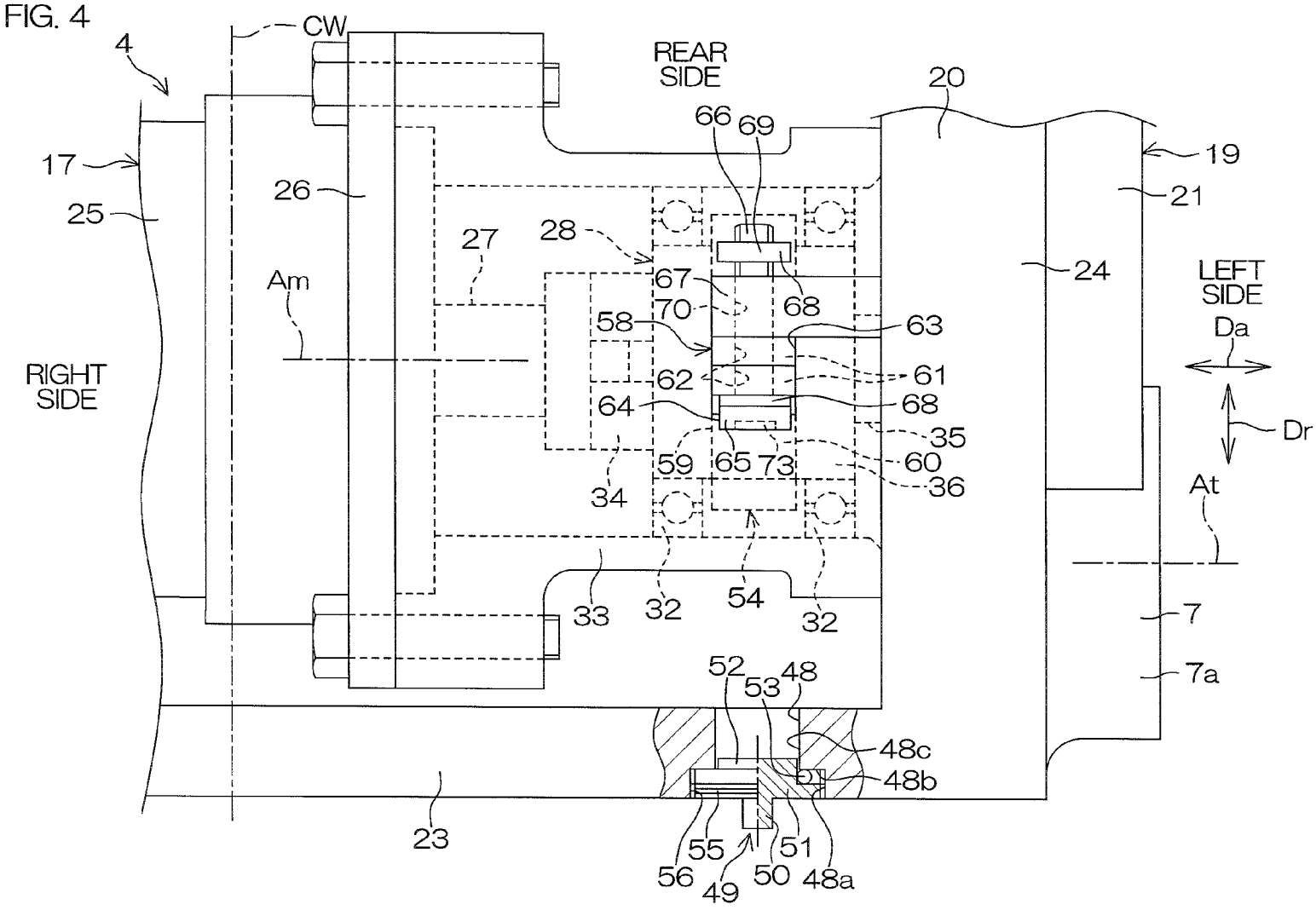
FIG. 4 is a schematic plan view showing a rotation stopper mechanism according to the first preferred embodiment of the present invention.

As shown in FIG. 4, the electric steering apparatus 4 includes a plug 49 that closes a rotation stopper adjusting hole 48 penetrating through the outer wall of the steering housing 19, an O-ring 53 that hermetically seals the gap between the outer peripheral surface of the plug 49 and the inner peripheral surface of the rotation stopper adjusting hole 48, and a rotation stopper mechanism 54 that restricts rotation of the casing 36.

As shown in FIG. 4, the rotation stopper adjusting hole 48 penetrates through the outer wall of the steering housing 19 in the thickness direction. Specifically, the rotation stopper adjusting hole 48 penetrates through any of the housing main body 20, the side covers 21, and the upper cover 22. FIG. 4 shows an example in which the rotation stopper adjusting hole 48 is provided in the front wall 23 of the steering housing 19. The rotation stopper adjusting hole 48 extends from the outer surface of the steering housing 19 toward the lock clutch 28. The rotation stopper adjusting hole 48 is disposed at a position viewable from a position on the hull H1. The rotation stopper adjusting hole 48 is disposed farther forward than the casing 36 of the lock clutch 28. The rotation stopper adjusting hole 48 and the casing 36 are aligned in the front-rear direction in a plan view. The rotation stopper adjusting hole 48 and the casing 36 face each other in the radial directions Dr of the casing 36. When the rotation stopper adjusting hole 48 is viewed from the forward side thereof, at least a portion of the rotation stopper adjusting hole 48 overlaps the casing 36.

As shown in FIG. 4, the rotation stopper adjusting hole 48 extends from the outer surface of the steering housing 19 to the inner surface of the steering housing 19. FIG. 4 shows an example in which the rotation stopper adjusting hole 48 is defined by a stepped inner peripheral surface. The inner peripheral surface of the rotation stopper adjusting hole 48 includes a cylindrical large-diameter portion 48*a* that extends from the outer surface of the steering housing 19 toward the inside of the steering housing 19, an annular portion 48*b* having a toric shape extending from the large-diameter portion 48*a* to the inner side, and a cylindrical small-diameter portion 48*c* extending from the annular portion 48*b* to the inner surface of the steering housing 19. The diameter of the large-diameter portion 48*a* is larger than the diameter of the small-diameter portion 48*c*. A female screw portion 56 to which a male screw portion 55 of the plug 49 is screwed is provided on the large-diameter portion 48*a*.

As shown in FIG. 4, the plug 49 includes a disk-shaped plug portion 51 provided with the male screw portion 55 on the outer periphery, a columnar seal holding portion 52 that holds the O-ring 53, and an operation portion 50 to be operated by a user to attach or detach the plug 49. The outer diameter of the plug portion 51 is larger than the outer diameter of the seal holding portion 52. The seal holding portion 52 is inserted into the O-ring 53. The O-ring 53 is disposed at a corner portion defined by an end face in the axial direction of the plug portion 51 and the outer peripheral surface of the seal holding portion 52. The seal holding portion 52 and the operation portion 50 extend to the sides opposite to each other from the plug portion 51.

Figure 5:
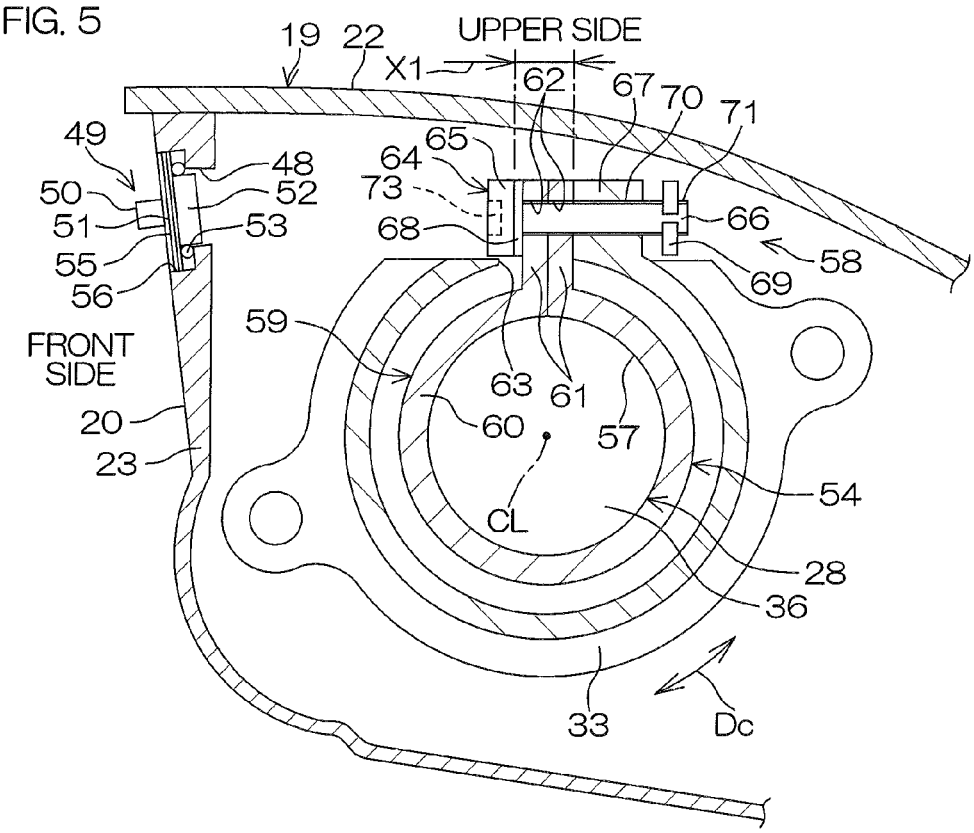
FIG. 5 is a schematic sectional view showing a lock state of the rotation stopper mechanism.
Figure 6:
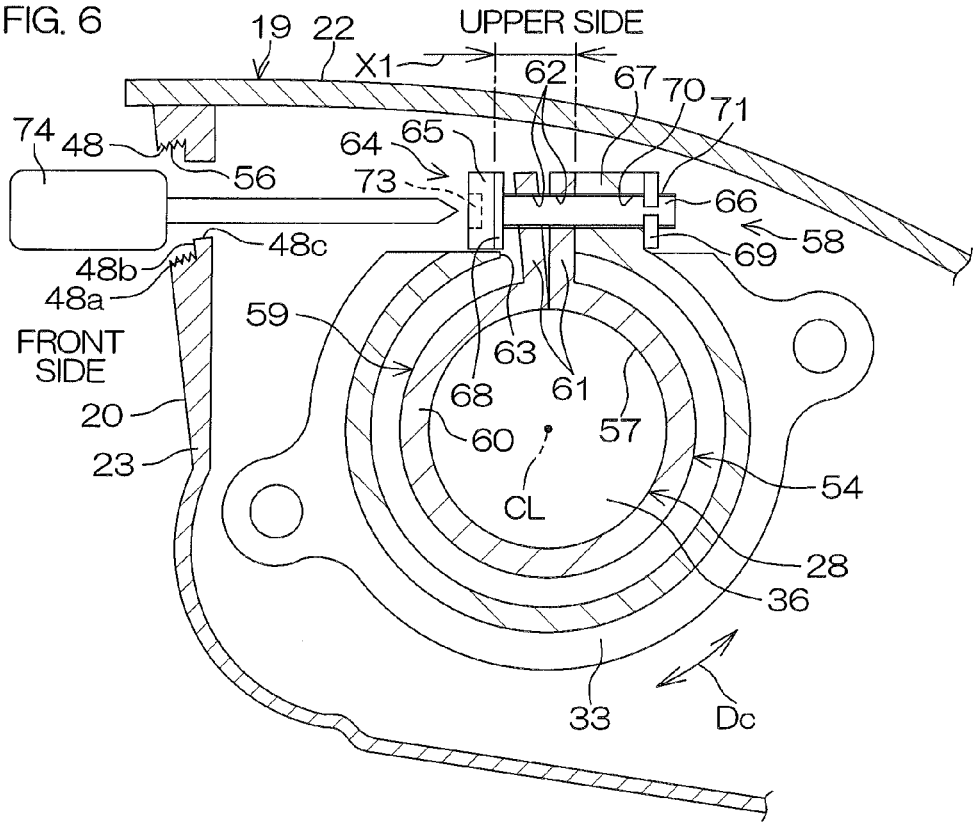
FIG. 6 is a schematic sectional view showing a release state of the rotation stopper mechanism.

As shown in FIG. 5 and FIG. 6, the plug 49 is movable between a closed position (position shown in FIG. 5) at which the plug 49 closes the rotation stopper adjusting hole 48, and an open position (position shown in FIG. 6) at which the plug 49 opens the rotation stopper adjusting hole 48. The plug 49 is held at the closed position by the male screw portion 55 and the female screw portion 56. When the plug 49 is at the closed position, the plug portion 51 is inserted into the large-diameter portion 48*a* of the rotation stopper adjusting hole 48, and the seal holding portion 52 is inserted into the small-diameter portion 48*c* of the rotation stopper adjusting hole 48. At this time, the O-ring 53 is sandwiched in the axial direction by the end face in the axial direction of the plug portion 51 and the annular portion 48*b* of the rotation stopper adjusting hole 48. Accordingly, the gap between the plug 49 and the rotation stopper adjusting hole 48 is hermetically sealed. The operation portion 50 is disposed outside the steering housing 19 when the plug 49 is at the closed position. When a user picks the operation portion 50 and rotates the plug 49, the plug 49 gradually moves toward the open position, and comes off the steering housing 19. Accordingly, the rotation stopper adjusting hole 48 is opened.

As shown in FIG. 5 and FIG. 6, the rotation stopper mechanism 54 is a friction mechanism that restricts rotation of the casing 36 by a frictional force acting between the pressed surface 57 to be pressed against the casing 36 and the casing 36. The rotation stopper mechanism 54 is switched between a lock state in which the rotation stopper mechanism 54 restricts rotation of the casing 36 and a release state in which the rotation stopper mechanism 54 releases the rotation restriction of the casing 36 by weakening the pressing force on the pressed surface 57 against the casing 36 to be smaller than in the lock state. The rotation stopper mechanism 54 includes a tightening band 59 including an inner surface on which the annular pressed surface 57 surrounding the casing 36 is provided, and a pressing mechanism 58 that adjusts the pressing force on the pressed surface 57 against the casing 36 by changing the inner diameter of the tightening band 59.

The tightening band 59 is preferably made of an elastic material such as resin or rubber. As shown in FIG. 5 and FIG. 6, the tightening band 59 includes a C-shaped band portion 60 surrounding the periphery of the casing 36 and a pair of bolt insertion portions 61 extending outward in the radial directions from both ends of the band portion 60 in the circumferential direction. The band portion 60 is disposed inside the clutch housing 33. The band portion 60 is disposed along the outer peripheral surface of the casing 36. The pair of bolt insertion portions 61 extend outward in the radial directions from the band portion 60 toward the inner peripheral surface of the clutch housing 33. The pair of bolt insertion portions 61 project outward from a through-hole 63 penetrating through the clutch housing 33. The pair of bolt insertion portions 61 include a pair of bolt insertion holes 62 facing each other. The bolt insertion holes 62 are disposed outside the clutch housing 33. As shown in FIG. 4, the pair of bolt insertion portions 61 are disposed between two bearings 32 in the axial direction Da of the casing 36.

As shown in FIG. 5, the pressing mechanism 58 is disposed around the lock clutch 28 inside the steering housing 19. The pressing mechanism 58 includes a fastening bolt 64 inserted into the pair of bolt insertion portions 61, and a bolt support portion 67 that supports a shaft portion 66 of the fastening bolt 64 so that the pair of bolt insertion portions 61 are positioned between the bolt support portion and the head portion 65 of the fastening bolt 64. The pressing mechanism 58 further includes a ring-shaped washer 68 interposed between the head portion 65 of the fastening bolt 64 and the pair of bolt insertion portions 61, and a C-shaped stopper ring 69 extending outward in the radial directions from the shaft portion 66 of the fastening bolt 64.

As shown in FIG. 5, the shaft portion 66 of the fastening bolt 64 is inserted into the bolt insertion holes 62 of the bolt insertion portions 61. Further, the shaft portion 66 of the fastening bolt 64 is inserted into an attaching hole 70 penetrating through the bolt support portion 67 in the axial direction of the fastening bolt 64. The bolt insertion holes 62 and the attaching hole 70 are aligned in the axial direction of the fastening bolt 64. The outer diameter of the stopper ring 69 is larger than the inner diameter of the attaching hole 70. The shaft portion 66 of the fastening bolt 64 penetrates through the bolt support portion 67 in the axial direction of the fastening bolt 64. The stopper ring 69 is disposed on the side opposite to the head portion 65 of the fastening bolt 64 with respect to the bolt support portion 67. The fastening bolt 64 is screwed to the bolt support portion 67 by the male screw portion 71 provided on the outer periphery of the shaft portion 66 of the fastening bolt 64 and the female screw portion provided on the inner peripheral surface of the attaching hole 70. The distance X1 between the head portion 65 of the fastening bolt 64 and the end face of the bolt support portion 67 is adjusted by relative rotation of the male screw portion 71 and the female screw portion.

As shown in FIG. 5, the pair of bolt insertion portions 61 of the tightening band 59 face each other in the axial direction of the fastening bolt 64. The pair of bolt insertion portions 61 are disposed between the head portion 65 of the fastening bolt 64 and the end face of the bolt support portion 67. The pair of bolt insertion portions 61 are sandwiched by the head portion 65 of the fastening bolt 64 and the end face of the bolt support portion 67 via the washer 68. Accordingly, the inner peripheral surface of the band portion 60, equivalent to the pressed surface 57, is pressed against the outer peripheral surface of the casing 36. Therefore, even when a force to rotate the casing 36 in the circumferential direction is applied to the casing 36, a frictional force that obstructs rotation of the casing 36 is generated between the tightening band 59 and the casing 36, and rotation of the casing 36 is restricted.

As shown in FIG. 5, the pair of bolt insertion portions 61 of the tightening band 59 are fixed to the clutch housing 33 by being sandwiched by the head portion 65 of the fastening bolt 64 and the end face of the bolt support portion 67. Accordingly, rotation of the tightening band 59 with respect to the clutch housing 33 is restricted. Therefore, in the state shown in FIG. 5 (lock state), rotation of the casing 36 with respect to the tightening band 59 is restricted, and rotation of the tightening band 59 with respect to the clutch housing 33 is restricted. The clutch housing 33 is fixed to the steering housing 19 via the steering motor 17. Therefore, in this state, rotation of the casing 36 with respect to the steering housing 19 is restricted.

When a user pushes the outboard motor 3 in the left-right direction or resistance of water caused by cruising is applied to the outboard motor 3, the force applied to the outboard motor 3 is transmitted to the output shaft 35 of the lock clutch 28 via the steering shaft 8. Specifically, a reverse input is generated. The torque applied to the output shaft 35 is transmitted to the casing 36, and transmission of the torque from the output shaft 35 to the input shaft 34 is shut off. As described above, in the state shown in FIG. 5, rotation of the casing 36 with respect to the steering housing 19 is restricted. Therefore, even when a reverse input is generated in this state, the steered angle of the outboard motor 3 does not change. Accordingly, in this state, even if the steering motor 17 is not driven, the steered angle of the outboard motor 3 is kept constant.

As shown in FIG. 6, the fastening bolt 64 includes a tool attaching portion 73 provided on the head portion 65 of the fastening bolt 64. The tool attaching portion 73 may be a recess portion into which the tip end portion of a tool 74 such as a screwdriver or a hexagonal wrench, or may be an outer peripheral portion having a polygonal sectional shape to the periphery of which a socket wrench is attached. FIG. 6 shows an example in which a recess portion into which the tip end portion of the tool 74 is inserted is provided on the end face of the head portion 65. The distance X1 between the head portion 65 of the fastening bolt 64 and the end face of the bolt support portion 67 is adjusted by rotating the fastening bolt 64 around the central axis thereof by a user with use of the tool 74. The rotation stopper adjusting hole 48 is disposed on the center line of the fastening bolt 64. The rotation stopper adjusting hole 48 is disposed ahead of the tool attaching portion 73. The rotation stopper adjusting hole 48 faces the tool attaching portion 73.

As shown in FIG. 6, to release the rotation restriction of the casing 36 by the rotation stopper mechanism 54, the plug 49 is removed from the rotation stopper adjusting hole 48 by a user. In this state, the tool 74 is inserted into the rotation stopper adjusting hole 48 by the user, and the tip end portion of the tool 74 is attached to the tool attaching portion 73 inside the steering housing 19. Thereafter, the fastening bolt 64 is rotated around its center line. Accordingly, the distance between the head portion 65 of the fastening bolt 64 and the end face of the bolt support portion 67 gradually increases, and the inner diameter of the band portion 60 gradually increases. Accordingly, the pressing force of the band portion 60 against the outer peripheral surface of the casing 36 decreases. Therefore, the restricting force applied to the casing 36 by the tightening band 59 weakens, and the casing 36 becomes rotatable (release state) with respect to the tightening band 59. Accordingly, the lock clutch 28 is disabled.

As shown in FIG. 6, in the release state, the pair of bolt insertion portions 61 of the tightening band 59 are separated in the axial direction of the fastening bolt 64. The inner diameter of the band portion 60 in the release state is set to a diameter that makes the casing 36 rotatable with respect to the band portion 60. Further, in the release state, the stopper ring 69 attached to the fastening bolt 64 is in contact with the bolt support portion 67. In other words, the position of the stopper ring 69 is set so that the stopper ring 69 is in contact with the bolt support portion 67 in the release state. When the stopper ring 69 comes into contact with the bolt support portion 67, movement in the axial direction of the fastening bolt 64 is restricted, so that the resistance in the circumferential direction applied to the tool 74 via the fastening bolt 64 increases. Therefore, based on the change in resistance to be transmitted via the tool 74, it is confirmed that the fastening bolt 64 has reached the release position (position shown in FIG. 6) by a user.

To restore the rotation restriction of the casing 36 by the rotation stopper mechanism 54, as in the case of releasing the rotation stop, the fastening bolt 64 is rotated around its center line by a user. Accordingly, the distance between the head portion 65 of the fastening bolt 64 and the end face of the bolt support portion 67 gradually decreases, and the pair of bolt insertion portions 61 gradually approach each other. Therefore, the inner diameter of the band portion 60 of the tightening band 59 gradually decreases, and the pressing force of the band portion 60 against the outer peripheral surface of the casing 36 increases. Therefore, the restricting force applied to the casing 36 by the tightening band 59 increases, and rotation of the casing 36 with respect to the steering housing 19 is restricted. Thereafter, the plug 49 is attached to the rotation stopper adjusting hole 48 by the user.

As described above, in the first preferred embodiment, when the rotation stopper mechanism 54 is in the lock state, rotation of the casing 36 is restricted by the rotation stopper mechanism 54. When a reverse input is generated, the force applied to the output shaft 35 of the lock clutch 28 is transmitted to the casing 36. In the lock state, rotation of the casing 36 is prevented, so that even when a reverse input is generated in the lock state, rotations of the output shaft 35 and the casing 36 are prevented. Therefore, even when a user pushes the outboard motor 3 in the left-right direction or a resistance of water caused by cruising is applied to the outboard motor 3, the steered angle of the outboard motor 3 does not change. Therefore, even if the steering motor 17 is not driven, the steered angle of the outboard motor 3 is kept constant.

On the other hand, when the rotation stopper mechanism 54 is in the release state, the rotation restriction of the casing 36 by the rotation stopper mechanism 54 is released. In this state, when a user pushes the outboard motor 3 in the left-right direction, the force applied to the outboard motor 3 is transmitted to the output shaft 35 via the steering shaft 8. Specifically, a reverse input is generated. The force applied to the output shaft 35 is transmitted to the casing 36. In the release state, the rotation restriction of the casing 36 is released, so that the casing 36 rotates together with the output shaft 35. In other words, in the release state, the lock clutch 28 is disabled, so that when a user pushes the outboard motor 3, the outboard motor 3 accordingly turns in the left-right direction.

Thus, the rotation stopper mechanism 54 enables the lock clutch 28 by restricting the rotation of the casing 36, and on the other hand, the rotation stopper mechanism 54 disables the lock clutch 28 by releasing the rotation restriction of the casing 36. Therefore, a user can manually steer the outboard motor 3 without shutting off the driving force transmission path (without shutting off the physical connection from the steering motor 17 to the steering shaft 8). Therefore, the adjusting operation after manual steering is eliminated. Further, the user can turn the outboard motor 3 in the left-right direction by directly pushing the outboard motor 3, so that the user can easily move the outboard motor 3 to a target steered angle in a short time. In addition, the rotation stopper mechanism 54 is only required to make the lock clutch 28 itself rotatable, so that a simple structure is applied to the rotation stopper mechanism 54. Accordingly, a complicated rotation stopper mechanism 54 is not required.

In the first preferred embodiment, the casing 36 is supported rotatably by the bearings 32. Therefore, when a torque is applied to the casing 36 while the rotation stopper mechanism 54 is in the release state, the casing 36 smoothly rotates. If the casing 36 does not smoothly rotate, when manually steering the outboard motor 3, resistance to be applied to the outboard motor 3 may increase, and the outboard motor 3 may not smoothly move in the left-right direction. Therefore, by supporting the casing 36 rotatably by the bearings 32, the outboard motor 3 is manually smoothly steered with a smaller force.

In the first preferred embodiment, the steering motor 17 and the lock clutch 28 are protected from water (including seawater and fresh water) by the steering housing 19. Further, the rotation stopper adjusting hole 48 extending from the outside of the steering housing 19 toward the lock clutch 28 is provided in the steering housing 19, so that a user can operate the rotation stopper mechanism 54 from the outside of the steering housing 19 through the rotation stopper adjusting hole 48. Specifically, a user can operate the rotation stopper mechanism 54 without inserting his/her hand into the steering housing 19. In addition, the plug 49 configured to open and close the rotation stopper adjusting hole 48 is provided, so that the sealing property of the steering housing 19 when the operation of the rotation stopper mechanism 54 is unnecessary is improved. Accordingly, the components disposed inside the steering housing 19 (steering motor 17, etc.) are more reliably protected from water.

In the first preferred embodiment, the rotation stopper adjusting hole 48 provided in the steering housing 19 is disposed at a position viewable from a position on the hull H1. Therefore, a user can operate the rotation stopper mechanism 54 from a position on the hull H1.

In the first preferred embodiment, the rotation stopper adjusting hole 48 provided in the steering housing 19 faces the casing 36 in the radial directions Dr of the casing 36. In other words, at least a portion of the rotation stopper adjusting hole 48 is disposed at the same position as the casing 36 in the axial direction Da of the casing 36. Therefore, the distance between the rotation stopper adjusting hole 48 and the casing 36 becomes shorter than in the case where the rotation stopper adjusting hole 48 and the casing 36 deviate from each other in the axial direction. If the distance between the rotation stopper adjusting hole 48 and the casing 36 is long, other members may be interposed between the rotation stopper adjusting hole 48 and the casing 36 and complicates the path from the rotation stopper adjusting hole 48 to the rotation stopper mechanism 54. Therefore, a path from the rotation stopper adjusting hole 48 to the rotation stopper mechanism 54 is prevented from being complicated by reducing the distance between the rotation stopper adjusting hole 48 and the casing 36.

In the first preferred embodiment, the pressed surface 57 provided on the rotation stopper mechanism 54 (friction mechanism) is pressed against the outer peripheral surface of the casing 36. In the lock state, rotation of the casing 36 is restricted by a frictional force acting between the pressed surface 57 and the casing 36. In the release state, the pressing force on the pressed surface 57 against the casing 36 is weakened to be smaller than in the lock state, and accordingly, the frictional force acting between the pressed surface 57 and the casing 36 is weakened to be smaller than in the lock state. Accordingly, the rotation restriction of the casing 36 is released.

Thus, the state of the rotation stopper mechanism 54 is switched by changing the pressing force on the pressed surface 57 against the casing 36. Therefore, the rotation stopper mechanism 54 enables and disables the lock clutch 28 without shutting off the driving force transmission path. Further, the position at which the pressed surface 57 is pressed may be an arbitrary position of the casing 36 as long as the position causes restriction of the rotation of the casing 36, so that it is not necessary to return the casing 36 to the original position (position before the outboard motor 3 is manually steered) when the lock clutch 28 is enabled again after the outboard motor 3 is manually steered. Therefore, the adjusting operation to enable the lock clutch 28 again is eliminated.

In the first preferred embodiment, the pressed surface 57 to be pressed against the outer peripheral surface of the casing 36 is provided on the inner surface of the tightening band 59 of the rotation stopper mechanism 54 (friction mechanism). The inner diameter of the tightening band 59 is changed by the pressing mechanism 58. Accordingly, the pressing force on the pressed surface 57 against the casing 36 is increased or decreased, and the state of the rotation stopper mechanism 54 is switched. The pressing surface 57 preferably has an annular shape surrounding the casing 36. Therefore, the contact area between the pressed surface 57 and the casing 36 increases. In addition, the tightening band 59 surrounds the entire circumference of the casing 36 in the lock state, so that the contact area between the pressed surface 57 and the casing 36 further increases. Therefore, the casing 36 is reliably held by the tightening band 59. Accordingly, the rotation stopper mechanism 54 more reliably restricts rotation of the casing 36 in the lock state.

Second Preferred Embodiment

Figure 7:
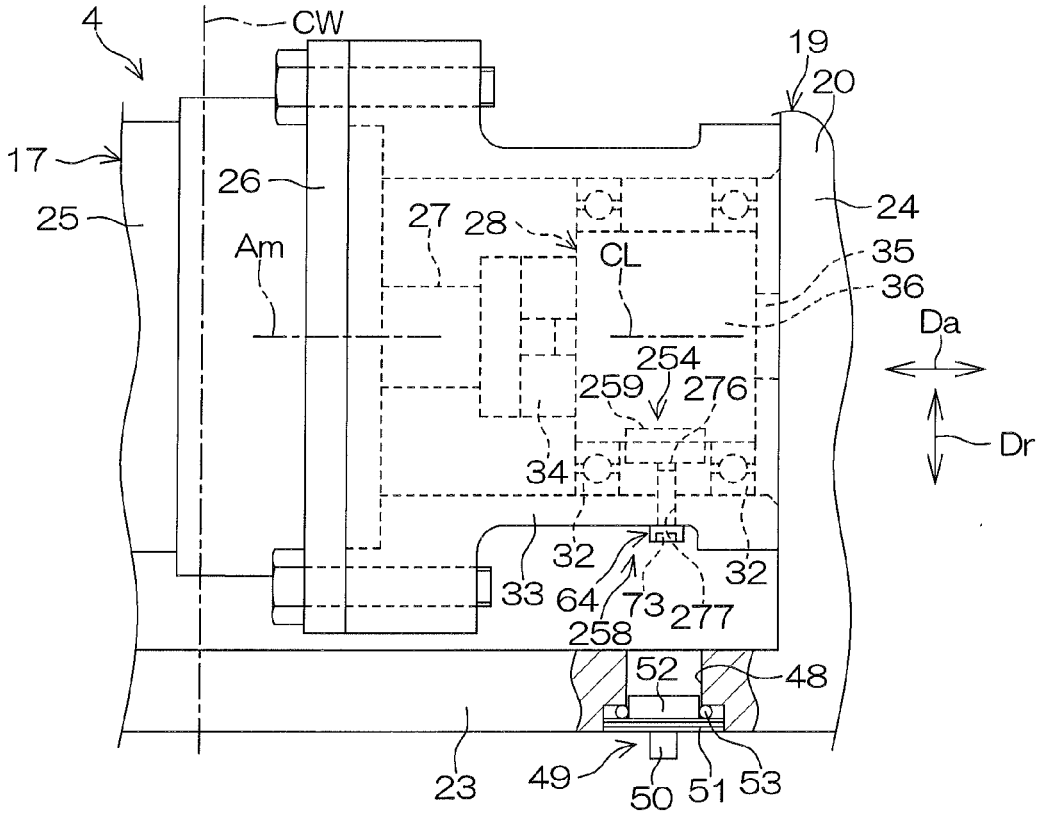
FIG. 7 is a schematic plan view showing a rotation stopper mechanism according to a second preferred embodiment of the present invention.
Figure 8:
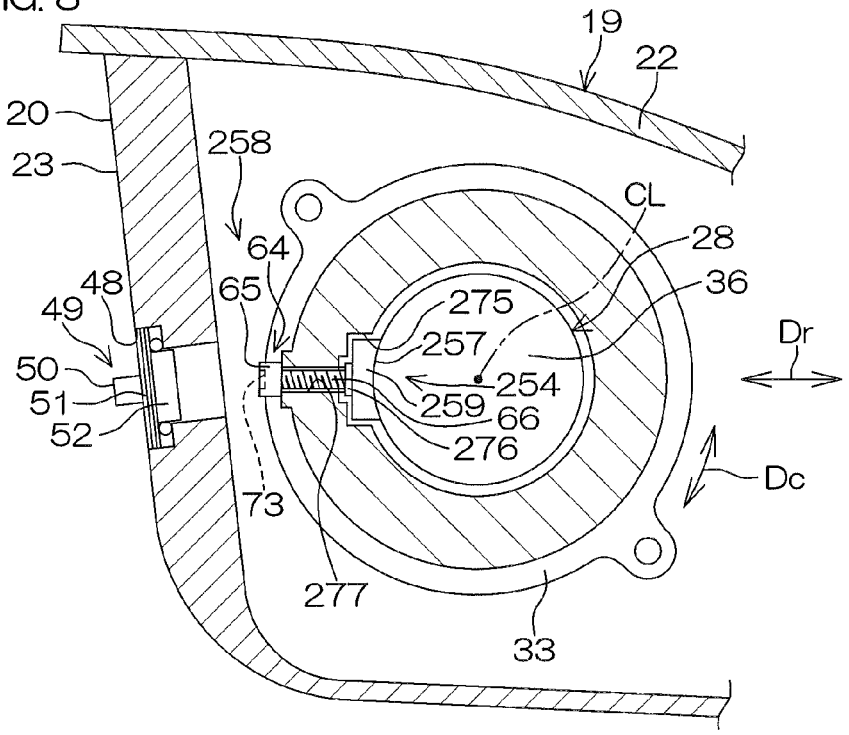
FIG. 8 is a schematic sectional view showing a lock state of the rotation stopper mechanism according to the second preferred embodiment of the present invention.

Next, a second preferred embodiment of the present invention is described. In FIG. 7 and FIG. 8 described below, components equivalent to those shown in FIG. 1 to FIG. 6 described above are designated by the same reference symbols as in FIG. 1, etc., and description thereof is omitted.

As shown in FIG. 8, an electric steering apparatus 4 according to the second preferred embodiment includes, instead of the rotation stopper mechanism 54 according to the first preferred embodiment, a rotation stopper mechanism 254 that presses a contact member 259 provided with a pressed surface 257 against the casing 36 in the radial direction Dr of the casing 36. The rotation stopper mechanism 254 is a friction mechanism including the contact member 259 provided with the pressed surface 257 and a pressing mechanism 258 that changes the force to push the contact member 259 toward the casing 36.

As shown in FIG. 7, the contact member 259 is disposed between the two bearings 32 in the axial direction Da of the casing 36. The contact member 259 is disposed inside the clutch housing 33. As shown in FIG. 8, the contact member 259 preferably has a tabular shape. The contact member 259 is disposed along the outer peripheral surface of the casing 36. The contact member 259 is accommodated in an accommodating recess portion 275 provided on the clutch housing 33. The accommodating recess portion 275 extends outward in the radial directions from the inner peripheral surface of the clutch housing 33. The contact member 259 is movable in the radial directions Dr of the casing 36 with respect to the accommodating recess portion 275. The movement of the contact member 259 in the circumferential direction Dc of the casing 36 is restricted by the contact between the contact member 259 and the inner surface of the accommodating recess portion 275.

As shown in FIG. 8, the end face of the contact member 259 faces the outer peripheral surface of the casing 36. The pressed surface 257 is provided on the end face of the contact member 259. The pressed surface 257 faces the outer peripheral surface of the casing 36 at a fixed interval. In the example shown in FIG. 8, the outer peripheral surface of the casing 36 is cylindrical or substantially cylindrical, so that the pressed surface 257 preferably has an arc sectional shape along the outer peripheral surface of the casing 36. The sectional shape of the pressed surface 257 may not be an arc as long as the pressed surface 257 has a shape facing the outer peripheral surface of the casing 36 at a fixed interval. For example, when the outer peripheral surface of the casing 36 is polygonal (for example, octagonal), the sectional shape of the pressed surface 257 may be linear.

As shown in FIG. 8, the pressing mechanism 258 is disposed around the lock clutch 28 inside the steering housing 19. The pressing mechanism 258 is disposed between the rotation stopper adjusting hole 48 and the contact member 259. The pressing mechanism 258 includes a fastening bolt movable between a lock position (position shown in FIG. 7 and FIG. 8) at which the pressed surface 257 is pressed against the casing 36, and a release position at which the pressing force on the pressed surface 257 against the casing 36 becomes smaller than in the case where the fastening bolt 64 is at the lock position, and a spring 276 interposed between the fastening bolt 64 and the contact member 259. The spring 276 is preferably a coil spring or a leaf spring.

As shown in FIG. 8, the fastening bolt 64 is inserted into a female screw hole 277 penetrating through the clutch housing 33 in its thickness direction. The fastening bolt 64 is held in a posture orthogonal or substantially orthogonal to the center line CL of the casing 36 by the clutch housing 33. The head portion 65 of the fastening bolt 64 is disposed outside the clutch housing 33, and the shaft portion 66 of the fastening bolt 64 is disposed between the head portion 65 of the fastening bolt 64 and the contact member 259. The spring 276 is sandwiched by the shaft portion 66 of the fastening bolt 64 and the contact member 259. The rotation stopper adjusting hole 48 is disposed on the center line of the fastening bolt 64. The head portion 65 of the fastening bolt 64 is disposed on the rear side of the rotation stopper adjusting hole 48. The head portion 65 of the fastening bolt 64 faces the rotation stopper adjusting hole 48.

FIG. 8 shows a state in which the fastening bolt 64 is at the lock position. In this state, the contact member 259 is pressed against the casing 36 in the radial directions Dr of the casing 36. Therefore, even if a force to rotate the casing 36 in the circumferential direction thereof is applied to the casing 36, a frictional force that obstructs rotation of the casing 36 is generated between the contact member 259 and the casing 36, and the rotation of the casing 36 is restricted. Further, the contact member 259 is restricted from moving in the circumferential direction Dc of the casing 36 by the inner surface of the accommodating recess portion 275. Therefore, even if a reverse input is generated in this state, the steered angle of the outboard motor 3 does not change.

To release the rotation restriction of the casing 36 by the rotation stopper mechanism 254, the plug 49 is removed from the rotation stopper adjusting hole 48 by a user. In this state, a tool is inserted into the rotation stopper adjusting hole 48 by the user, and the tip end portion of the tool is attached to the tool attaching portion 73 inside the steering housing 19. Thereafter, the fastening bolt 64 is rotated around its center line. Accordingly, the fastening bolt 64 gradually moves outward in the radial directions, and the distance in the radial directions between the fastening bolt 64 and the casing 36 increases. Therefore, the force of the spring 276 to push the contact member 259 inward in the radial directions weakens. Therefore, the restricting force applied by the contact member 259 to the casing 36 weakens, and the casing 36 becomes rotatable (release state) with respect to the contact member 259. Accordingly, the lock clutch 28 is disabled.

To restore the rotation restriction of the casing 36 by the rotation stopper mechanism 254, as in the case of releasing the rotation stop, the fastening bolt 64 is rotated around its center line by a user. Accordingly, the fastening bolt 64 gradually approaches the casing 36, and the distance in the radial directions between the fastening bolt 64 and the casing 36 decreases. Therefore, the force of the spring 276 to push the contact member 259 inward in the radial directions increases. Therefore, the restricting force applied by the contact member 259 to the casing 36 increases, and the rotation of the casing 36 with respect to the steering housing 19 is restricted. Thereafter, the plug 49 is attached to the rotation stopper adjusting hole 48 by the user.

As described above, in the second preferred embodiment, the pressed surface 257 to be pressed against the outer peripheral surface of the casing 36 is provided on the contact member 259 of the rotation stopper mechanism 254 (friction mechanism). The force to push the contact member 259 toward the casing 36 is changed by the pressing mechanism 258. Accordingly, the pressing force on the pressed surface 257 against the casing 36 is increased or decreased, and the state of the rotation stopper mechanism 254 is switched. Therefore, the rotation stopper mechanism 254 enables and disables the lock clutch 28 without shutting off the driving force transmission path.

Third Preferred Embodiment

Figure 9:
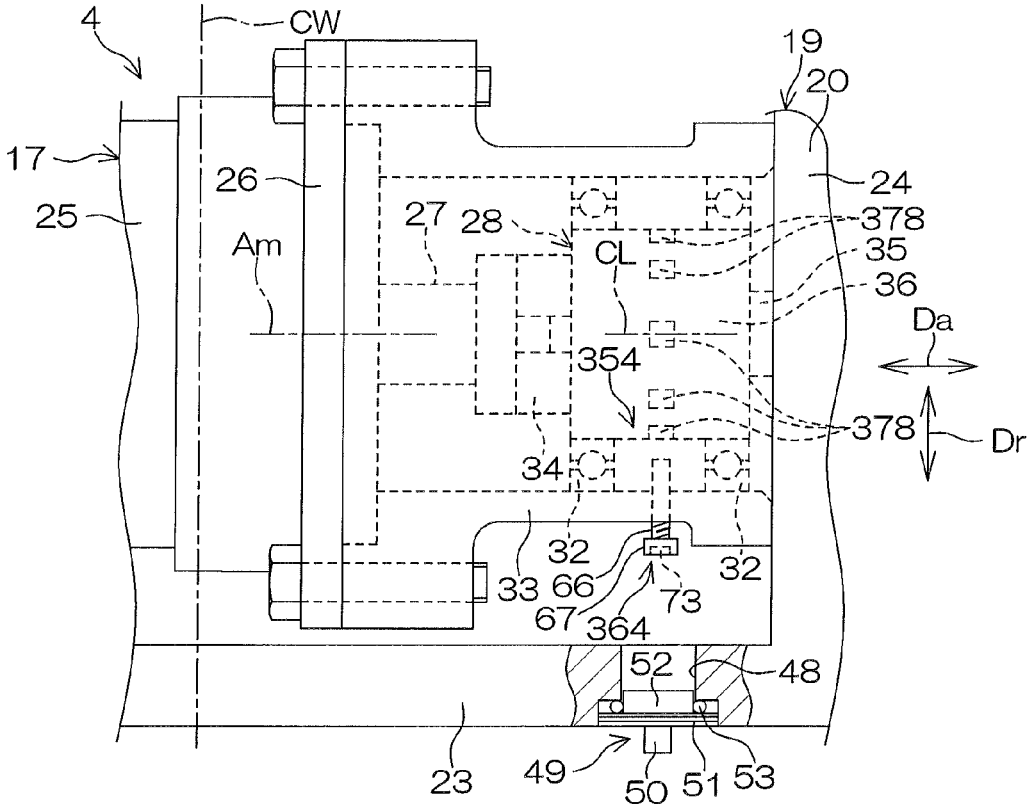
FIG. 9 is a schematic plan view showing a rotation stopper mechanism according to a third preferred embodiment of the present invention.
Figure 10:
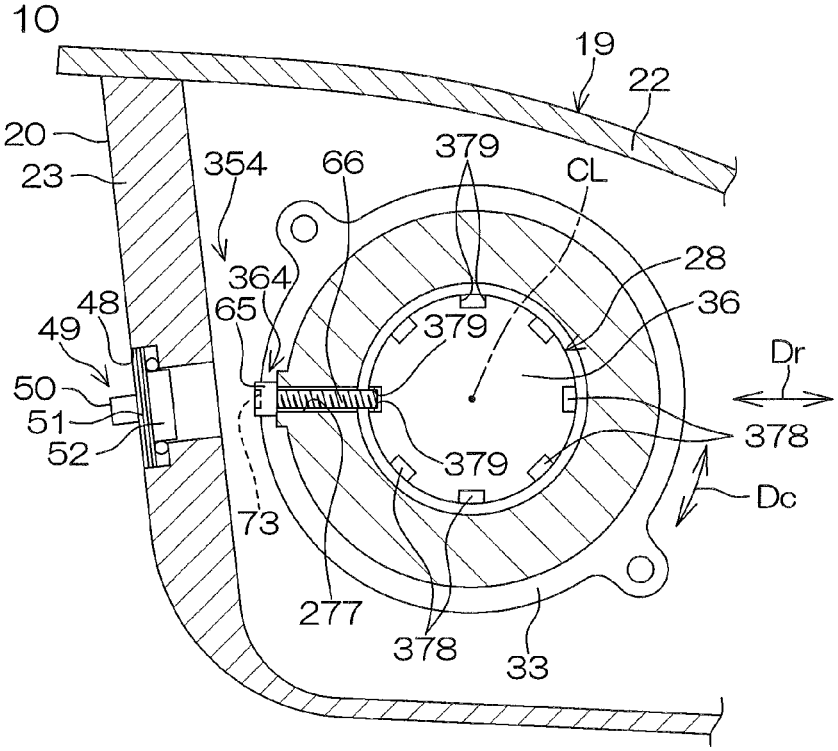
FIG. 10 is a schematic sectional view showing a lock state of the rotation stopper mechanism according to the third preferred embodiment of the present invention.

Next, a third preferred embodiment of the present invention is described. In FIG. 9 and FIG. 10 described below, the components equivalent to those shown in FIG. 1 to FIG. 8 are designated by the same reference symbols as in FIG. 1, etc., and description thereof is omitted.

As shown in FIG. 10, an electric steering apparatus 4 according to the third preferred embodiment includes, instead of the rotation stopper mechanism 54 according to the first preferred embodiment, a rotation stopper mechanism 354 that restricts rotation of the casing 36 by a stopper bolt 364 that is orthogonal or substantially orthogonal to the center line CL of the casing 36 and extends along a straight line passing through the center line CL. The rotation stopper mechanism 354 is a stopper mechanism including a plurality of rotation stopper portions 378 recessed inward in the radial directions on the outer peripheral portion of the casing 36, and a stopper bolt 364 movable between a lock position (position shown in FIG. 10) at which the stopper bolt 364 faces any of the plurality of rotation stopper portions 378 and a release position (position shown in FIG. 9) at which facing to the plurality of rotation stopper portions 378 is released.

As shown in FIG. 9, the plurality of rotation stopper portions 378 are disposed between the two bearings 32 in the axial direction Da of the casing 36. As shown in FIG. 10, the plurality of rotation stopper portions 378 are provided on the outer peripheral portion of the casing 36. The plurality of rotation stopper portions 378 are aligned at intervals in the circumferential direction Dc of the casing 36. The rotation stopper portions 378 are recessed inward in the radial directions from the outer peripheral surface of the casing 36. The rotation stopper portions 378 are opened at the outer peripheral surface of the casing 36. Each rotation stopper portion 378 includes a pair of facing portions 379 facing each other in the circumferential direction Dc of the casing 36. The pair of facing portions 379 face each other at an interval in the circumferential direction Dc of the casing 36.

As shown in FIG. 10, the stopper bolt 364 is inserted into a female screw hole 277 of the clutch housing 33. The stopper bolt 364 is held in a posture orthogonal or substantially orthogonal to the center line CL of the casing 36 by the clutch housing 33. The head portion 65 of the stopper bolt 364 is disposed outside the clutch housing 33, and the shaft portion 66 of the stopper bolt 364 is disposed between the head portion 65 of the stopper bolt 364 and the casing 36. The rotation stopper adjusting hole 48 is disposed on the center line of the stopper bolt 364. The head portion 65 of the stopper bolt 364 is disposed on the rear side of the rotation stopper adjusting hole 48. The head portion 65 of the stopper bolt 364 faces the rotation stopper adjusting hole 48. The tool attaching portion 73 is provided on the head portion 65 of the stopper bolt 364.

The stopper bolt 364 is movable between the lock position (position shown in FIG. 10) and the release position (position shown in FIG. 9) with respect to the casing 36 and the clutch housing 33. The lock position is a position at which a portion of the stopper bolt 364 is accommodated in any of the plurality of rotation stopper portions 378. The release position is a position at which the whole stopper bolt 364 is disposed farther outward in the radial directions than the plurality of rotation stopper portions 378. In the state shown in FIG. 10, the shaft portion 66 of the stopper bolt 364 is accommodated in one rotation stopper portion 378. Therefore, the shaft portion 66 of the stopper bolt 364 is disposed between the pair of facing portions 379, and face both facing portions 379 in the circumferential direction Dc of the casing 36. As viewed in the axial direction Da of the casing 36, the pair of facing portions 379 are disposed on the sides opposite to each other with respect to the stopper bolt 364.

When a user pushes the outboard motor 3 in the left-right direction or a resistance of water caused by cruising is applied to the outboard motor 3, a reverse input is generated, and as a result, a force to rotate the casing 36 clockwise or counterclockwise is applied to the casing 36. In the state shown in FIG. 10 (lock state), the shaft portion 66 of the stopper bolt 364 is disposed between the pair of facing portions 379 in the circumferential direction. Therefore, in this state, when a clockwise torque is applied to the casing 36, due to contact between one of the pair of facing portions 379 and the stopper bolt 364, clockwise rotation of the casing 36 is restricted. Similarly, in this state, when a counterclockwise torque is applied to the casing 36, due to contact between the other one of the pair of facing portions 379 and the stopper bolt 364, counterclockwise rotation of the casing 36 is restricted. Therefore, even if a reverse input is generated in this state, the steered angle of the outboard motor 3 does not change.

To release the rotation restriction of the casing 36 by the rotation stopper mechanism 354, the plug 49 is removed from the rotation stopper adjusting hole 48 by a user. In this state, a tool is inserted into the rotation stopper adjusting hole 48 by the user, and the tip end portion of the tool is attached to the tool attaching portion 73 inside the steering housing 19. Thereafter, the stopper bolt 364 is rotated around its center line. Accordingly, the stopper bolt 364 gradually moves outward in the radial directions, and the distance in the radial directions between the stopper bolt 364 and the casing 36 increases. Therefore, the stopper bolt 364 comes off the rotation stopper portion 378, and facing between the stopper bolt 364 and the rotation stopper portion 378 is released. Therefore, the casing 36 becomes rotatable (release state) with respect to the steering housing 19. Accordingly, the lock clutch 28 is disabled.

To restore the rotation restriction of the casing 36 by the rotation stopper mechanism 354, the casing 36 is disposed at a position at which any of the plurality of rotation stopper portions 378 faces the stopper bolt 364 in the radial directions Dr of the casing 36. For example, by turning the outboard motor 3 in the left-right direction by a user, the position of the casing 36 in the circumferential direction is adjusted. Thereafter, as in the case of releasing the rotation stop, the stopper bolt 364 is rotated around its center line by the user. Accordingly, the stopper bolt 364 gradually approaches the casing 36, and the shaft portion 66 of the stopper bolt 364 is inserted into the rotation stopper portion 378. Accordingly, rotation of the casing 36 with respect to the steering housing 19 is restricted. Thereafter, the plug 49 is attached to the rotation stopper adjusting hole 48 by the user.

As described above, in the third preferred embodiment, in the lock state, the stopper bolt 364 is disposed at the lock position (position at which the stopper bolt 364 comes into contact or is contactable with the casing 36). Even if a torque is applied to the casing 36 in the lock state, rotation of the casing 36 is restricted by contact between the casing 36 and the stopper bolt 364. In the release state, the stopper bolt 364 is disposed at the release position (position at which the stopper bolt 364 cannot come into contact with the casing 36). Accordingly, the rotation restriction of the casing 36 is released. Thus, the state of the rotation stopper mechanism 354 is switched by changing the position of the stopper bolt 364. Therefore, the rotation stopper mechanism 354 enables and disables the lock clutch 28 without shutting off the driving force transmission path.

Further, the rotation stopper mechanism 354 includes a plurality of rotation stopper portions 378 aligned in the circumferential direction Dc of the casing 36. The stopper bolt 364 restricts rotation of the casing 36 regardless of which of the rotation stopper portions 378 the stopper bolt 364 faces. Therefore, to enable the lock clutch 28 again after the outboard motor 3 is manually steered, it is not necessary to return the casing 36 to the original position (position before the outboard motor 3 is manually steered). Therefore, the adjusting operation to enable the lock clutch 28 again is eliminated.

Fourth Preferred Embodiment

Figure 11:
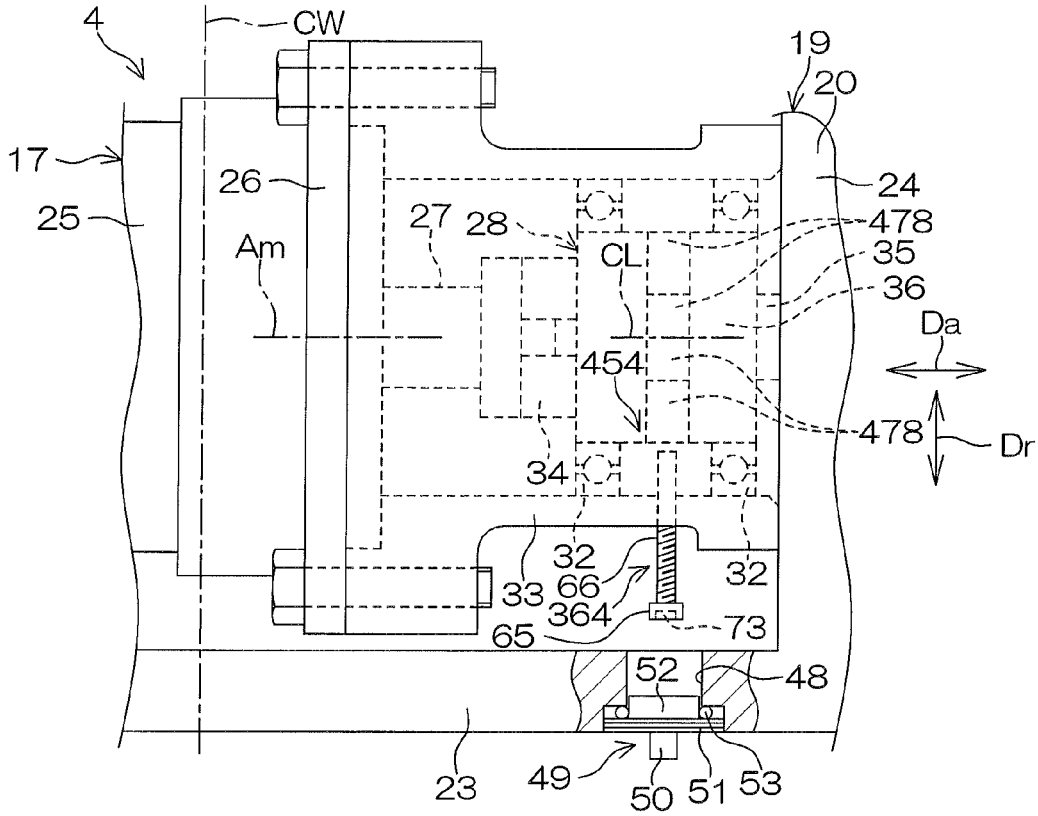
FIG. 11 is a schematic plan view showing a rotation stopper mechanism according to a fourth preferred embodiment of the present invention.
Figure 12:
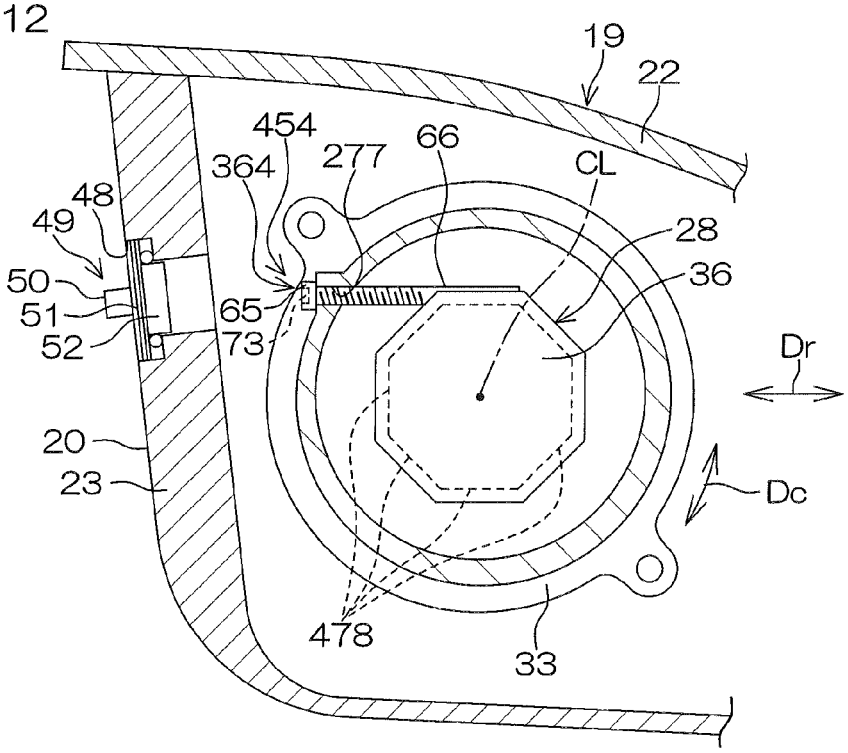
FIG. 12 is a schematic sectional view showing a lock state of the rotation stopper mechanism according to the fourth preferred embodiment of the present invention.
Figure 13:
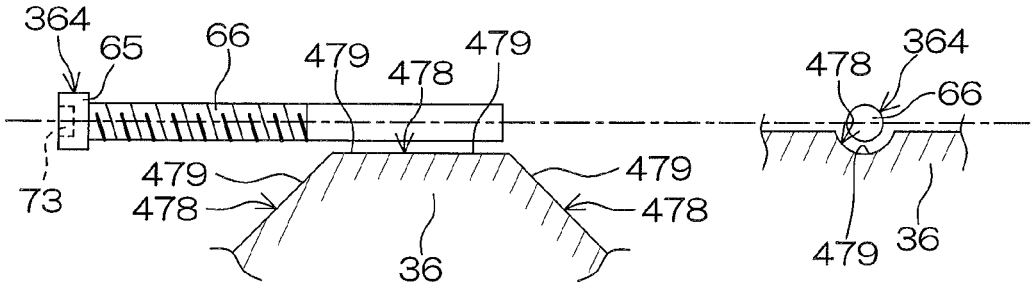
FIG. 13 is a schematic view showing rotation stopper portions according to the fourth preferred embodiment of the present invention.

Next, a fourth preferred embodiment of the present invention is described. In FIG. 11 to FIG. 13 described below, components equivalent to those shown in FIG. 1 to FIG. 10 described above are designated by the same reference symbols as in FIG. 1, etc., and description thereof is omitted.

As shown in FIG. 12, an electric steering apparatus 4 according to a fourth preferred embodiment includes, instead of the rotation stopper mechanism 54 according to the first preferred embodiment, the rotation stopper mechanism 454 that restricts rotation of the casing 36 by a stopper bolt 364 orthogonal or substantially orthogonal to the center line CL of the casing 36 and extending along a straight line that does not cross the center line CL. The rotation stopper mechanism 454 is a stopper mechanism including a plurality of rotation stopper portions 478 recessed inward in the radial directions on the outer peripheral portion of the casing 36, and a stopper bolt 364 movable between a lock position (position shown in FIG. 12) at which the stopper bolt 364 faces any of the plurality of rotation stopper portions 478 and a release position (position shown in FIG. 11) at which the stopper bolt 364 faces to the plurality of rotation stopper portions 478 is released.

As shown in FIG. 11, the plurality of rotation stopper portions 478 are disposed between the two bearings 32 in the axial direction Da of the casing 36. As shown in FIG. 12 and FIG. 13, the plurality of rotation stopper portions 478 are provided on the outer peripheral portion of the casing 36. The plurality of rotation stopper portions 478 are aligned in the circumferential direction Dc of the casing 36. The sectional shape of the plurality of rotation stopper portions 478 orthogonal or substantially orthogonal to the center line CL of the casing 36 is preferably polygonal. Each rotation stopper portion 478 defines a groove recessed inward in the radial direction from the outer peripheral surface of the casing 36. Each rotation stopper portion 478 is opened at the outer peripheral surface of the casing 36. Each rotation stopper portion 478 extends along a straight line that is orthogonal or substantially orthogonal to the center line CL of the casing 36 and does not cross the center line CL. Each rotation stopper portion 478 includes a pair of facing portions 479 aligned in the direction orthogonal or substantially orthogonal to the center line CL of the casing 36. Rotation of the casing 36 is restricted by contact between the pair of facing portions 479 and the stopper bolt 364.

As shown in FIG. 12, the stopper bolt 364 is inserted into a female screw hole 277 of the clutch housing 33. The stopper bolt 364 is held in a posture orthogonal or substantially orthogonal to the center line CL of the casing 36 by the clutch housing 33. The head portion 65 of the stopper bolt 364 is disposed outside the clutch housing 33, and the shaft portion 66 of the stopper bolt 364 is disposed over the casing 36. The rotation stopper adjusting hole 48 is disposed on the center line of the stopper bolt 364. The head portion 65 of the stopper bolt 364 is disposed on the rear side of the rotation stopper adjusting hole 48. The head portion 65 of the stopper bolt 364 faces the rotation stopper adjusting hole 48.

As shown in FIG. 12, the stopper bolt 364 is movable between the lock position (position shown in FIG. 12 and FIG. 13) and the release position (position shown in FIG. 11) with respect to the casing 36 and the clutch housing 33. The lock position is a position at which a portion of the stopper bolt 364 is accommodated in any of the plurality of rotation stopper portions 478. The release position is a position at which the whole stopper bolt 364 is disposed farther outward in the radial directions than the plurality of rotation stopper portions 478. In the state shown in FIG. 12, the shaft portion 66 of the stopper bolt 364 is accommodated in one rotation stopper portion 478. Therefore, the shaft portion 66 of the stopper bolt 364 faces both facing portions 479 provided on the same rotation stopper portion 478. As viewed in the axial direction Da of the casing 36, the pair of facing portions 479 are disposed on the same side with respect to the stopper bolt 364.

When a force to turn the outboard motor 3 in the left-right direction is applied to the outboard motor 3 without passing through the steering shaft 8, a reverse input is generated, and as a result, a force to rotate the casing 36 clockwise or counterclockwise is applied to the casing 36. In the state (lock state) shown in FIG. 12, the shaft portion 66 of the stopper bolt 364 faces the pair of facing portions 479 in the up-down direction. Therefore, in this state, when a clockwise torque is applied to the casing 36, due to contact between one of the pair of facing portions 479 and the stopper bolt 364, clockwise rotation of the casing 36 is restricted. Similarly, when a counterclockwise torque is applied to the casing 36 in this state, due to contact between the other one of the pair of facing portions 479 and the stopper bolt 364, counterclockwise rotation of the casing 36 is restricted. Therefore, even when a reverse input is generated in this state, the steered angle of the outboard motor 3 does not change.

To release the rotation restriction of the casing 36 by the rotation stopper mechanism 454, the plug 49 is removed from the rotation stopper adjusting hole 48 by a user. In this state, a tool is inserted into the rotation stopper adjusting hole 48 by the user, and the tip end portion of the tool is attached to the tool attaching portion 73 inside the steering housing 19. Thereafter, the stopper bolt 364 is rotated around its center line. Accordingly, the stopper bolt 364 gradually moves outward in the radial directions. Therefore, the stopper bolt 364 comes off the rotation stopper portion 478, and facing between the stopper bolt 364 and the rotation stopper portion 478 is released. Therefore, the casing 36 becomes rotatable (release state) with respect to the steering housing 19. Accordingly, the lock clutch 28 is disabled.

To restore the rotation restriction of the casing 36 by the rotation stopper mechanism 454, the casing 36 is disposed at a position at which any of the plurality of rotation stopper portions 478 extends along the center line of the stopper bolt 364 and the female screw hole 277. For example, by turning the outboard motor 3 in the left-right direction by the user, the position of the casing 36 in the circumferential direction is adjusted. Thereafter, as in the case of releasing the rotation stop, the stopper bolt 364 is rotated around its center line by the user. Accordingly, the stopper bolt 364 gradually approaches the casing 36, and the shaft portion 66 of the stopper bolt 364 is inserted into the rotation stopper portion 478. Accordingly, rotation of the casing 36 with respect to the steering housing 19 is restricted. Thereafter, the plug 49 is attached to the rotation stopper adjusting hole 48 by the user.

As described above, in the fourth preferred embodiment, a stopper bolt 364 as a stopper member is provided in the rotation stopper mechanism 454 (stopper mechanism). In the lock state, the stopper bolt 364 is disposed at the lock position (position at which the stopper bolt 364 comes into contact or is contactable with the casing 36). Therefore, even if a torque is applied to the casing 36 in the lock state, rotation of the casing 36 is restricted by contact between the casing 36 and the stopper bolt 364. In the release state, the stopper bolt 364 is disposed at the release position (position at which the stopper bolt 364 cannot come into contact with the casing 36). Accordingly, the rotation restriction of the casing 36 is released. Thus, the state of the rotation stopper mechanism 454 is switched by changing the position of the stopper bolt 364. Further, the plurality of rotation stopper portions 478 are aligned in the circumferential direction Dc of the casing 36, so that the adjusting operation to enable the lock clutch 28 again is eliminated.

Other Preferred Embodiments

Although first to fourth preferred embodiments of the present invention have been described above, the present invention is not restricted to the contents of the first to fourth preferred embodiments and various modifications are possible within the scope of the present invention.

Figure 14:
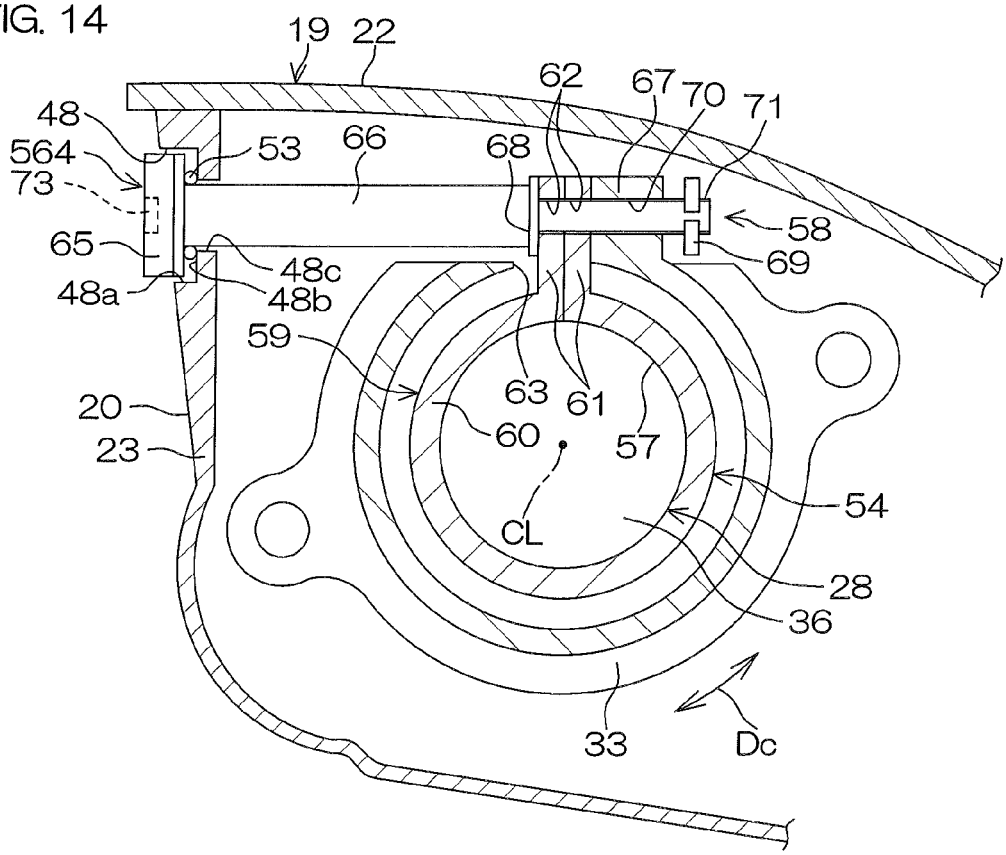
FIG. 14 is a schematic sectional view showing a lock state of a rotation stopper mechanism according to a fifth preferred embodiment of the present invention.

For example, in the first to fourth preferred embodiments described above, the case where the plug 49 preferably is movable independently of the fastening bolt 64 and the stopper bolt 364 is described. However, the plug 49 and the fastening bolt 64 may be configured to rotate integrally. Specifically, as shown in FIG. 14, an operation member 564 serving as both of the plug 49 and the fastening bolt 64 may be provided in the electric steering apparatus 4. Similarly, an operation member serving as both of the plug 49 and the stopper bolt 364 may be provided in the electric steering apparatus 4. The operation member 564 may be an integral member shown in FIG. 14, or may be a plurality of members joined to each other.

When the operation member 564 is provided, according to an operation of the operation member 564 by a user, the rotation stopper mechanism 54 is switched between the lock state and the release state. As shown in FIG. 14, a portion of the operation member 564 is disposed inside the rotation stopper adjusting hole 48 opened at the outer surface of the steering housing 19. Therefore, the user can operate the operation member 564 without removing the operation member 564 from the rotation stopper adjusting hole 48. Further, the user is not required to insert a portion of the tool into the steering housing 19 through the rotation stopper adjusting hole 48, so that the user can more easily operate the rotation stopper mechanism 54.

In the first to fourth preferred embodiments described above, the case where the casing 36 is supported by the clutch housing 33 via the bearings 32 is described. However, the casing 36 may be directly supported by the clutch housing 33. Specifically, the bearings 32 may be omitted.

In the first to fourth preferred embodiments described above, the case where the rotation stopper adjusting hole 48 closed by the plug 49 is provided in the front wall 23 of the steering housing 19, and is disposed at a position viewable from a position on the hull H1, is described. However, the rotation stopper adjusting hole 48 may be provided in a portion other than the front wall 23 of the steering housing 19, and may not be viewable from a position on the hull H1. The rotation stopper adjusting hole 48 and the plug 49 may be omitted. In this case, the rotation stopper mechanism 54 may be operated in a state in which at least one of the side covers 21 and the upper cover 22 is removed.

In the first to fourth preferred embodiments described above, the case where the rotation stopper adjusting hole 48 and the casing 36 face each other in the radial directions Dr of the casing 36 is described. However, the rotation stopper adjusting hole 48 and the casing 36 may not face in the radial directions. For example, the whole rotation stopper adjusting hole 48 may be disposed at a position different from the position of the casing 36 in the axial direction Da of the casing 36.

In the first to fourth preferred embodiments described above, the case where the O-ring 53 is held by the seal holding portion 52 of the plug 49 is described. However, an annular groove that accommodates the O-ring 53 may be provided on the outer peripheral portion of the plug portion 51. In this case, the seal holding portion 52 may be omitted. The O-ring 53 may be held not by the plug 49 but by the steering housing 19 inside the rotation stopper adjusting hole 48.

In the first to fourth preferred embodiments described above, the case where the fastening bolt 64 and the stopper bolt 364 are directly operated by a user is described. However, an electric actuator that rotates the fastening bolt 64 may be provided. Similarly, an electric actuator that rotates the stopper bolt 364 may be provided. Specifically, the fastening bolt 64 and the stopper bolt 364 may be automatically operated according to a user's command.

In the first preferred embodiment described above, the case where the tightening band 59 is preferably made of an elastic material such as resin or rubber is described. However, the tightening band 59 may be made of a material other than resin and rubber.

In the first preferred embodiment described above, the case where the washer 68 and the stopper ring 69 preferably are attached to the fastening bolt 64 is described. However, one or both of the washer 68 and the stopper ring 69 may be omitted.

In the second preferred embodiment described above, the case where the contact member 259 preferably is pushed by the fastening bolt 64 via the spring 276 is described. However, the shaft portion 66 of the fastening bolt 64 may come into contact with the contact member 259, and the contact member 259 may be directly pushed by the fastening bolt 64. Specifically, the spring 276 interposed between the fastening bolt 64 and the contact member 259 may be omitted.

In the third and fourth preferred embodiments described above, the case where the plurality of rotation stopper portions 378 preferably are provided on the casing 36 is described. However, the number of rotation stopper portions 378 provided on the casing 36 may be one.

Also, features of two or more of the various preferred embodiments described above may be combined.

The present invention corresponds to Japanese Patent Application No. 2013-206512 filed on Oct. 1, 2013 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electric steering apparatus for a vessel propulsion apparatus, the electric steering apparatus comprising:

a steering motor configured to generate a driving force to turn a steering shaft joined to an outboard motor;

a lock clutch including an input shaft to which rotation is transmitted from the steering motor, an output shaft configured to transmit the rotation transmitted to the input shaft to the steering shaft, and a casing configured to rotatably hold the input shaft and the output shaft, the lock clutch being configured to transmit a driving force from the input shaft to the output shaft when a forward input in which a driving force is transmitted from the steering motor to the steering shaft is generated, and to transmit a driving force from the output shaft to the casing so as to shut off a driving force transmission from the output shaft to the input shaft when a reverse input in which a driving force is transmitted from the steering shaft to the steering motor is generated; and a rotation stopper mechanism configured to switch between a lock state in which the rotation stopper mechanism restricts rotation of the casing and a release state in which the rotation stopper mechanism releases a rotation restriction of the casing.

2. The electric steering apparatus for a vessel propulsion apparatus according to claim 1, further comprising a bearing configured to rotatably support the casing.

3. The electric steering apparatus for a vessel propulsion apparatus according to claim 1, further comprising:

a steering housing configured to house the steering motor and the lock clutch, and define a rotation stopper adjusting hole extending from an outside of the electric steering apparatus toward the lock clutch; and a plug configured to move between a closed position at which the plug closes the rotation stopper adjusting hole and an open position at which the plug opens the rotation stopper adjusting hole.

4. The electric steering apparatus for a vessel propulsion apparatus according to claim 1, further comprising:

a steering housing configured to house the steering motor and the lock clutch, and define a rotation stopper adjusting hole extending from an outside of the electric steering apparatus toward the lock clutch; wherein the rotation stopper mechanism includes an operation member configured to close the rotation stopper adjusting hole and is operated to switch the rotation stopper mechanism between the lock state and the release state.

5. The electric steering apparatus for a vessel propulsion apparatus according to claim 3, wherein the rotation stopper adjusting hole is provided in a front wall of the steering housing, and is disposed at a position viewable from a position on a hull.

6. The electric steering apparatus for a vessel propulsion apparatus according to claim 3, wherein the rotation stopper adjusting hole is positioned such that the rotation stopper adjusting hole and the casing of the lock clutch face each other in radial directions of the casing.

7. The electric steering apparatus for a vessel propulsion apparatus according to claim 1, wherein the rotation stopper mechanism includes a friction mechanism configured to switch between a lock state in which the rotation stopper mechanism restricts rotation of the casing by a frictional force acting between a pressed surface pressed against the casing and the casing, and a release state in which the rotation stopper mechanism releases the rotation restriction of the casing by weakening a pressing force on the pressed surface against the casing to be smaller than in the lock state.

8. The electric steering apparatus for a vessel propulsion apparatus according to claim 7, wherein the friction mechanism includes a tightening band including an inner surface on which the pressed surface that has an annular shape surrounding the casing is provided, and a pressing mechanism configured to adjust the pressing force on the pressed surface against the casing by changing an inner diameter of the tightening band.

9. The electric steering apparatus for a vessel propulsion apparatus according to claim 8, wherein the tightening band surrounds an entire circumference of the casing.

10. The electric steering apparatus for a vessel propulsion apparatus according to claim 7, wherein the friction mechanism includes a contact member including the pressed surface and a pressing mechanism configured to adjust the pressing force on the pressed surface against the casing by changing a force to push the contact member toward the casing.

11. The electric steering apparatus for a vessel propulsion apparatus according to claim 1, wherein the rotation stopper mechanism includes a stopper mechanism configured to switch between a lock state in which the stopper mechanism restricts rotation of the casing by contact between the casing and a stopper member, and a release state in which the stopper mechanism releases the rotation restriction of the casing by releasing the contact between the casing and the stopper member.

12. The electric steering apparatus for a vessel propulsion apparatus according to claim 11, wherein the stopper mechanism includes a plurality of rotation stopper portions provided on the casing and aligned in a circumferential direction of the casing, and a stopper member configured to move between a lock position at which the stopper member faces any of the plurality of rotation stopper portions and a release position at which the stopper member and the plurality of rotation stopper portions do not face each other, and restrict rotation of the casing by contact between any of the plurality of rotation stopper portions and the stopper member.

13. A vessel propulsion apparatus comprising:

the electric steering apparatus according to claim 1;

a steering shaft configured to be turned around a center line of the steering shaft by the electric steering apparatus; and an outboard motor configured to turn around the center line of the steering shaft together with the steering shaft.

* * * * *